US009366982B2

(12) United States Patent
Yamamoto et al.

(10) Patent No.: US 9,366,982 B2
(45) Date of Patent: Jun. 14, 2016

(54) TONER, DEVELOPER, AND IMAGE FORMING APPARATUS

(71) Applicants: Atsushi Yamamoto, Osaka (JP); Hiroshi Yamada, Shizuoka (JP); Takamasa Hase, Shizuoka (JP); Kohsuke Nagata, Shizuoka (JP)

(72) Inventors: Atsushi Yamamoto, Osaka (JP); Hiroshi Yamada, Shizuoka (JP); Takamasa Hase, Shizuoka (JP); Kohsuke Nagata, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/274,875

(22) Filed: May 12, 2014

(65) Prior Publication Data

US 2014/0342283 A1 Nov. 20, 2014

(30) Foreign Application Priority Data

May 15, 2013 (JP) ..... 2013-102756

(51) Int. Cl.

| | |
|---|---|
| ***G03G 9/087*** | (2006.01) |
| ***G03G 15/08*** | (2006.01) |
| ***G03G 9/08*** | (2006.01) |

(52) U.S. Cl.

CPC ..... *G03G 9/08764* (2013.01); *G03G 9/0819* (2013.01); *G03G 9/0825* (2013.01); *G03G 9/08755* (2013.01); *G03G 9/08797* (2013.01); *G03G 15/0865* (2013.01)

(58) Field of Classification Search

CPC ..... G03G 9/08755; G03G 9/08764

See application file for complete search history.

(56) References Cited

U.S. PATENT DOCUMENTS

| | | | | |
|---|---|---|---|---|
| 2001/0046636 | A1 | 11/2001 | Daimon et al. | |
| 2003/0039910 | A1 | 2/2003 | Shirai et al. | |
| 2006/0105258 | A1* | 5/2006 | Ishiyama et al. | 430/108.4 |
| 2008/0102395 | A1* | 5/2008 | Ohmura et al. | 430/109.4 |
| 2011/0129773 | A1 | 6/2011 | Shu et al. | |
| 2011/0244383 | A1 | 10/2011 | Yamamoto et al. | |
| 2012/0021349 | A1 | 1/2012 | Tani et al. | |
| 2012/0282000 | A1 | 11/2012 | Nakayama et al. | |
| 2013/0078563 | A1 | 3/2013 | Nakayama et al. | |
| 2013/0095422 | A1 | 4/2013 | Yamamoto et al. | |
| 2013/0108950 | A1 | 5/2013 | Yamamoto et al. | |
| 2013/0244153 | A1 | 9/2013 | Nakayama et al. | |
| 2013/0244154 | A1 | 9/2013 | Yamamoto et al. | |

FOREIGN PATENT DOCUMENTS

| | | |
|---|---|---|
| EP | 2 410 381 A1 | 1/2012 |
| JP | 04-024702 | 4/1992 |
| JP | 04-024703 | 4/1992 |

(Continued)

OTHER PUBLICATIONS

Diamond, "Handbook of Imaging Materials," Marcel Dekker, NY, NY, 1991. pp. 380-382.*

(Continued)

*Primary Examiner* — Peter Vajda

(74) *Attorney, Agent, or Firm* — Oblon, McClelland, Maier & Neustadt, L.L.P

(57) ABSTRACT

To provide a toner for developing an electrostatic image, the toner including toner particles, wherein the toner particles contain: a non-crystalline resin A; and a crystalline resin, wherein the crystalline resin contains a crystalline resin C containing a urethane bond, or a urea bond, or both thereof, and wherein the toner particles each have a sea-island structure, where the resin C is dispersed in the non-crystalline resin on a cross-section of the toner particle.

9 Claims, 1 Drawing Sheet

(56) References Cited

FOREIGN PATENT DOCUMENTS

| | | |
|---|---|---|
| JP | 3589451 | 8/2004 |
| JP | 3910338 | 2/2007 |
| JP | 2008-281884 | 11/2008 |
| JP | 2009-229920 | 10/2009 |
| JP | 2010-077419 | 4/2010 |
| JP | 2011-113020 | 6/2011 |
| JP | 2011-145587 | 7/2011 |
| JP | 2012-042508 | 3/2012 |
| JP | 2012-068589 | 4/2012 |
| JP | 2012-078584 | 4/2012 |
| JP | 2012-088353 | 5/2012 |
| JP | 4999525 | 5/2012 |
| WO | WO 2013/137368 A1 | 9/2013 |
| WO | WO 2014/046218 A1 | 3/2014 |

OTHER PUBLICATIONS

Extended European Search Report issued Nov. 17, 2014 in Patent Application No. 14166778.2.

* cited by examiner

TONER, DEVELOPER, AND IMAGE FORMING APPARATUS

BACKGROUND OF THE INVENTION

1. Field of the Invention

The present invention relates to such a toner for developing an electrostatic image that it is excellent in storage stability, and low temperature fixing ability and capable of forming an image of excellent image quality, which contains less fogging.

2. Description of the Related Art

Conventionally, an electrically or magnetically formed latent image in an electrophotographic image forming apparatus is visualized with a toner for electrophotography (may be referred merely as a "toner" hereinafter). In the electrophotography, for example, a static image (latent image) is formed on a photoconductor, followed by developing the latent image with a toner, to thereby form a toner image. The toner image is typically transferred onto a transfer medium, such as paper, followed by being fixed on the transfer member, such as paper. In a fixing step where the toner image is fixed on the transfer paper, a thermal fixing system, such as a heat roller fixing system, and a heat belt fixing system, is widely used because of excellent energy efficiency.

Recently, in the market, there is an increasing need for increased printing speed and energy saving of image forming apparatuses. To this end, desired is a toner having excellent low temperature fixing ability, and capable of providing high quality images. In order to achieve low temperature fixing ability of a toner, it is necessary to lower softening temperature of a binder resin of a toner. When the softening temperature of the binder resin is low, however, so-called offset (may be also referred to as hot offset hereinafter), which is a phenomenon that part of a toner image is deposited on a surface of a fixing member during fixing, and the deposited toner is transferred on a photocopy sheet, tends to occur. Moreover, heat resistant storage stability of the toner is impaired, and so-called blocking, which is a phenomenon that toner particles are fused to each other especially in high temperature environments, tends to occur. Other than those mentioned above, there are problems that the toner is fused onto an inner area of a developing device or a carrier inside the developing device to cause pollution, and filming of the toner tends to be caused on a surface of the photoconductor.

As for techniques for solving these problems, use of a crystalline resin as a binder resin of a toner has been known (see Japanese Patent Application Laid-Open (JP-A) Nos. 2010-077419, 2012-068589, 2011-145587, 2009-229920, and 2008-281884, Japanese Patent (JP-B) No. 3589451, JP-A Nos. 2012-078584 and 2011-113020, and JP-B No. 4999525). Specifically, the crystalline resin can be sharply softened at a melting point of the resin, and the softening temperature of the toner can be lowered to the temperature around the melting point thereof, while maintaining heat resistant storage stability of the toner at the melting point thereof or lower. Therefore, low temperature fixing ability and heat resistant storage stability can be both achieved to a certain degree.

However, there is a problem that pollution of a toner component tends to occur in an image forming apparatus especially due to a continuous use of the image forming apparatus, and image quality tends to be degraded due to aggregations of toner particles.

Meanwhile, as for a toner using a crystalline resin, disclosed is, for example, a toner using, as a binder resin, a crystalline resin obtained by elongating crystalline polyester with diisocyanate (see JP-B Nos. 04-024702 and 04-024703). Moreover, disclosed is a toner using, as a binder resin, a crystalline resin obtained by modifying crystalline polyester with diisocyanate and diol (see JP-A No. 2012-088353). Furthermore, disclosed is a toner using, as a binder resin, a resin obtained by linking crystalline polyester and non-crystalline polyester with diisocyanate (see JP-A No. 2012-042508). Moreover, disclosed is a toner using a crystalline resin having a cross-link structure due to an unsaturated bond containing a sulfonic acid group (see JP-B No. 3910338). Moreover, disclosed is a technology where a ratio of softening temperature and peak temperature of heat of melting, and viscoelastic properties are specified to achieve resin particles having excellent low temperature fixing ability and heat resistant storage stability. These toners can achieve both low temperature fixing ability and heat resistant storage stability for sure, and hot offset resistance thereof is also improved. However, plastic deformability or elongation deformability of a crystalline resin itself cannot be fundamentally removed even by introducing a crosslink structure or a hard segment, such as a urethane bond or urea bond to the crystalline resin. The problem of the pollution of the toner component to the image forming apparatus especially due to continuous use of the image forming apparatus or degradation of image quality due to aggregations of the toner particles has not been solved.

SUMMARY OF THE INVENTION

The present invention aims to solve the aforementioned various problems in the art, and to achieve the following object.

Specifically, the object of the present invention is to provide a toner having excellent low temperature fixing ability, hot offset resistance, and heat resistant storage stability without causing filming, and to provide a developer containing the toner.

The object is achieved by the present invention including the following toner, developer, and image forming apparatus.

(1) A toner, containing:

toner particles, wherein the toner particles contain:

a non-crystalline resin A; and a crystalline resin, wherein the crystalline resin contains a crystalline resin C containing a urethane bond, or a urea bond, or both thereof, and wherein the toner particles each have a sea-island structure, where the resin C is dispersed in the non-crystalline resin on a cross-section of the toner particle.

(2) The toner according to (1), wherein an aspect ratio of the resin C dispersed on the cross-section is 1 to 2.

(3) The toner according to any of (1) or (2), wherein the resin C dispersed on the cross-section has an average particle diameter of 50 nm to 500 nm.

(4) The toner according to any one of (1) to (3), wherein an area of the resin C dispersed on the cross-section is less than 50% or less relative to an entire area of the toner particle.

(5) The toner according to any one of (1) to (4), wherein an area of the resin C dispersed on the cross-section is 10% to 45% relative to an entire area of the toner particle.

(6) The toner according to any one of (1) to (5), wherein the resin C has a melting point of 40° C. to 70° C.

(7) The toner according to any one of (1) to (6), wherein the toner particles further contain a releasing agent having a melting point of 60° C. to 85° C.

(8) The toner according to (7), wherein an ethyl acetate soluble component in the releasing agent at 50° C. is less than 10% by mass.

(9) The toner according to any one of (1) to (8), wherein a component represented by the following general formula (1) is 0 mol % to 10 mol % relative to an alcohol component constituting the non-crystalline resin:

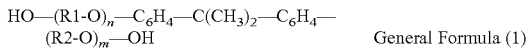

$$HO—(R1\text{-}O)_n—C_6H_4—C(CH_3)_2—C_6H_4—(R2\text{-}O)_m—OH \quad \text{General Formula (1)}$$

where R1 and R2 are each C2-C4 divalent saturated hydrocarbon linking group, and n and m are each a positive number of 1 to 2.

(10) A developer, containing:

a carrier; and the toner according to any one of (1) to (9).

(11) An image forming apparatus, containing:

a developing unit configured to develop an electrostatic latent image, where the developing unit houses the toner according to any one of (1) to (9).

The present invention can provide a toner, which has excellent low temperature fixing ability and heat resistant storage stability, causes less pollution to a member and aggregation thereof when it is continuously used in an image forming apparatus, and gives excellent image quality over a long period of time.

DETAILED DESCRIPTION OF THE INVENTION

Figure 1A:
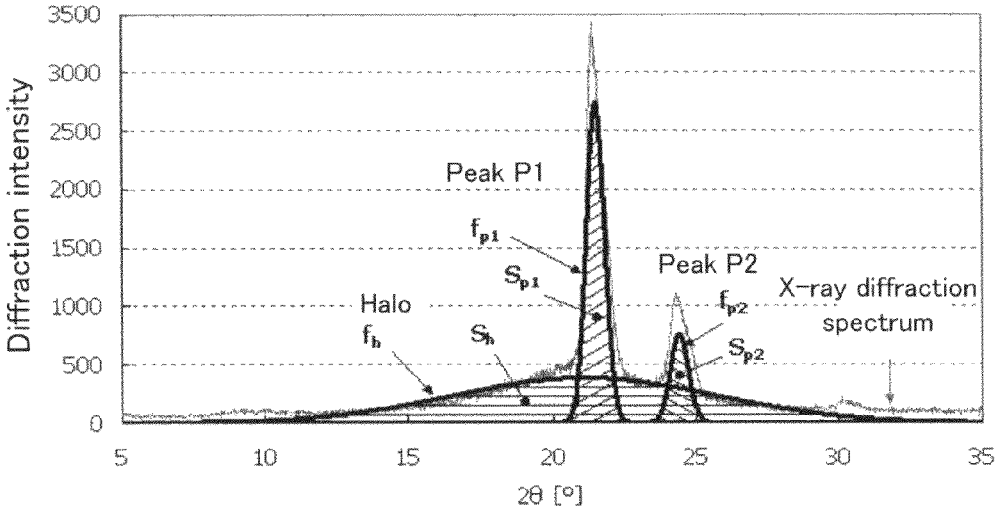
FIG. 1A is a diagram depicting one example of a diffraction spectrum obtained by X-ray diffraction spectroscopy.

The present invention is explained in details hereinafter.

The present inventors have diligently conducted researches on the aforementioned problems, and found out as follows. A toner, which has excellent low temperature fixing ability with securing storage stability in high temperature high humidity environment, and gives less pollution to a photoconductor and does not cause aggregation of toner particles as an image forming apparatus is continuously used to thereby maintain excellent image quality, can be provided, when the toner contains a crystalline resin C containing a urethane or urea bond, as a crystalline resin, and a sea-island structure is formed on a cross-section structure of the toner particle, in which the resin C is dispersed in a non-crystalline resin.

An example where a non-crystalline polyester resin and a crystalline polyester resin are used as a non-crystalline resin and a crystalline resin, respectively, is specifically explained hereinafter.

First, reasons why an effect of the present invention is exhibited is explained.

Conventionally, it has been well known that low temperature fixing ability of a toner is improved by adding a crystalline resin having an appropriate melting point to the toner, typically adding a crystalline polyester resin. Moreover, low temperature fixing ability is improved further by increasing an amount of the crystalline polyester resin. In reality, however, an amount of the crystalline polyester resin for use is limited, because image quality is reduced after storage or continuous printing due to properties of the crystalline polyester resin itself, or reduction in heat resistant storage stability caused by partial blending of the crystalline polyester resin and the non-crystalline polyester resin, pollution of a soft material derived from the crystalline polyester to a photoconductor, and aggregation of toner particles due to deformation of the toner particles themselves. In a toner containing a binder resin composed of only a crystalline polyester resin, a problem of partial blending is fundamentally solved, and therefore heat resistant storage stability is secured by sufficiently increasing the melting point of the crystalline polyester resin, but mechanical strength of the resin itself is not sufficient. Therefore, plastic deformation or elongation deformation tends to be cause, and pollution to a photoconductor or aggregation of toner particles due to continuous printing cannot be prevented.

Accordingly, exposure of the crystalline polyester resin can be prevented, and heat resistant storage stability and low temperature fixing ability can be secured by dispersing a crystalline resin (e.g., a crystalline polyester resin) in a non-crystalline resin (e.g., a noncrystalline polyester resin) mechanical strength of which is secured in a glass state to form a sea-island structure where the non-crystalline polyester resin is sea, and the crystalline polyester resin is islands. As an amount of the crystalline polyester resin added increases, however, low mechanical strength of the crystalline polyester resin affects the whole toner, and therefore pollution to a photoconductor and occurrences of aggregation of toner particles cannot be sufficiently prevented.

By introducing a urethane bond or urea bond segment to part of the crystalline polyester resin, therefore, the urethane bond segment or the urea bond segment functions as a physical crosslink point to improve mechanical strength of the crystalline polyester resin, and therefore pollution to a photoconductor or aggregation of toner particles can be prevented while securing low temperature fixing ability. In this manner as described, the present invention is accomplished.

Moreover, a shape of the crystalline polyester resin present in the form of islands is preferably close to spherical, as a ratio of the crystalline polyester resin to be exposed to the surface can be reduced, and an effect of preventing pollution to a photoconductor caused by continuous printing can be improved even further. Specifically, the shape of the crystalline polyester resin in the cross-section of the toner particle is determined as an aspect ratio, which is preferably 1 to 2.

An example of a suitable method for realizing a novel structure of the toner particle of the present invention, including the aforementioned shape of the crystalline polyester resin in the toner particle, is explained hereinafter. In order to simply and surely attain a novel morphology in the present invention, it is preferred that attentions be paid on both materials for use and a production process. However, the below-described is merely one example, and does not deny, for example, that this toner particle structure is realized in another method in the future.

The crystalline polyester resin typically has a form, such as plate crystals, and needle crystals, due to the crystallinity thereof. As the crystalline polyester resin is dispersed, for example, in an aqueous medium, therefore, plate-shaped or needle-shaped dispersed elements are obtained. In a toner obtained by aggregating and cohering such dispersed elements, and separately prepared dispersed elements of a non-crystalline polyester resin, dispersed elements of a pigment, and dispersed elements of a releasing agent, the crystalline polyester resin is present in the form of plates or needles in the toner. In the case where the crystalline polyester resin has such shapes, the crystalline polyester resin tends to be exposed to a surface. In a case where the crystalline polyester resin is precipitated as particles by dissolving in a dispersion medium once by a method, such as heating or pressurizing, and cooling with stirring, the obtained dispersed elements are in the shape of plates or needles, and therefore such the dispersed elements tend to be exposed to a surface if added to a toner.

There is a method in which a shape close to a sphere is formed from a shape of high aspect ratio, such as needles or plates by reducing mobility of molecular chains in a crystal growth system in order to prevent a growth of crystals, for example, by reducing an amount of the crystalline polyester resin dissolved in a dispersion medium through removal of the dispersion medium, at the same time as dissolving a polymer that is dissolved in a separate dispersing medium, in the dispersion medium, to thereby cause a phase separation of the crystalline polyester resin, and form crystals in the system where the phase separation is caused. Moreover, a dispersion state where dispersed elements are close to spheres can be realized by reducing crystallinity of the crystalline polyester resin itself through design of a resin skeleton to prevent systematic formation of a crystal structure. As for a method for reducing crystallinity of the crystalline polyester resin, there is a method where regularity is disheveled by introducing a structure other than a structure exhibiting crystallinity. For example, it can be realized by appropriately introducing a urethane bond segment or urea bond segment.

The method for causing the phase separation of the crystalline polyester resin through removal of the dispersion medium can be performed at the same time as granulation of the toner. In production of a toner according to dissolution suspension, for example, toner materials, such as a non-crystalline polyester resin, a crystalline polyester resin, a pigment, and a releasing agent, are dissolved or dispersed in a solvent, the resulting solution or dispersion liquid is heated to the temperature at which the crystalline polyester resin can be dissolved in the solvent, to thereby form an oil phase, the oil phase is dispersed in an aqueous medium to form particles, the solvent is removed with maintaining the temperature, and finally the temperature is reduced to thereby control the shape of the crystalline polyester resin present in the toner to the shape close to a sphere.

The shape of the crystalline polyester resin can be also controlled with the speed for reducing the temperature. When the cooling speed is slow, for example, the shape of the crystalline polyester resin tends to be a plate shape or needle shape, as crystallization is progressed before the shape of the crystalline polyester resin is determined. When the cooling speed is fast, the shape of the crystalline polyester resin tends to be a sphere, as crystallization of the crystalline polyester resin is caused after a phase separation between the crystalline polyester resin and the non-crystalline polyester resin. In the case where the cooling speed is too fast, however, an entire toner particle may be solidified before occurrence of a phase separation between the crystalline polyester resin and the non-crystalline polyester resin. In this case, the crystalline polyester and the non-crystalline polyester cannot form a sea-island structure.

As for a size of the crystalline polyester resin present as islands, the equivalent circle diameter (average particle diameter) thereof on the cross section of the toner particle is preferably 50 nm to 500 nm. When the size thereof is smaller than 50 nm, the crystalline polyester resin and the non-crystalline polyester resin are practically in a state close to a miscible state, and therefore an effect of preventing pollution to a photoconductor caused by continuous printing and aggregation of toner particles becomes small. When the size thereof is greater than 500 nm, on the other hand, the crystalline polyester resin tends to be exposed to a surface. Even if the crystalline polyester resin is remained inside the toner particle, in this case, a resulting toner tends to be deformed upon application of external force, as the crystalline polyester resin is not completely undeformable even through plastic deformation or elongation deformation is suppressed by introducing a urethane bond or urea bond, and interfacial peeling may occur, as domains of the crystalline polyester resin are large and thus distortion between the crystalline polyester resin and the non-crystalline polyester resin is large due to deformation. Therefore, strength of the toner may be reduced.

The size of the crystalline polyester resin present in the form of islands can be controlled by the crystalline polyester resin, the non-crystalline polyester resin forming sea, and production conditions of a toner.

For example, the size of the crystalline polyester resin becomes smaller, as the structure or polarity (SP value) of the crystalline polyester resin and that of the non-crystalline polyester resin are closer to each other. When the structure or polarity (SP value) of the crystalline polyester resin and that of the non-crystalline polyester resin are too close, the crystalline polyester resin and the non-crystalline polyester resin are mixed to form a homogeneous phase, without forming a sea-island structure. A relationship of the structure of the crystalline polyester resin or the non-crystalline polyester resin needs to consider not only each resin as a whole, but also a partial structure of each resin.

In the case where the crystalline polyester resin has a urethane bond segment or a urea bond segment, or the case where each of these bond segments is a unit having a certain length, for example, the crystalline polyester resin is easily dispersed in the non-crystalline polyester resin, and the size of the crystalline polyester resin tends to be small. When a ratio of the urethane bond segment or urea bond segment is large, however, it may be difficult to disperse the crystalline polyester resin.

[State of Crystalline Polyester Resin present in Toner]

A state of the crystalline polyester resin in the toner particle can be observed, for example, through a transmission electron microscope (TEM). As for the transmission electron microscope, for example, a device commonly known in the art, such as LEM-2000 (manufactured by TOPCON CORPORATION), and JEM-2000FX (manufactured by JEOL Ltd.), can be used for observation. First, the toner particles are embedded in an epoxy resin, which is curable at room temperature, and the epoxy resin is cured. Next, a flake sample is cut out from the epoxy resin by a microtome equipped with a diamond blade, and a photograph is taken by a transmission electron microscope (TEM) with a magnification (about 10,000 times) at which a cross-section of one toner particle is fit in a field of view. For observation, the flake sample may be tinted with ruthenium tetraoxide or osmium tetraoxide.

<Measuring Method of Aspect Ratio>

The aspect ratio is measured from a photograph of a cross-section of a toner particle taken by a transmission electron microscope.

First, a major axis and minor axis of a domain of the crystalline polyester resin are determined by analyzing an image obtained by a transmission electron microscope. Specifically, two horizontal lines with a gap between then being the maximum is determined when the outline of the domain of the crystalline polyester resin is sandwiched with the two horizontal lines that are in contact with the outline.

A line segment composed of a straight line formed between two contact points at which the two horizontal lines and the outline of the domain of the crystalline polyester resin are in contact is called a major axis, and a length of this line segment is called a length of the major axis.

Subsequently, a gap of two horizontal lines to the obtained major axis, when the domain of the crystalline polyester resin is sandwiched with the horizontal lines, is determined as a length of a minor axis.

A value obtained by dividing the length of the major axis with the length of the minor axis is the aspect ratio of one crystalline polyester resin.

The average aspect ratio is obtained by randomly selecting 20 toner particles, determining an aspect ratio of a domain of the crystalline polyester resin present in a cross section of each toner particle, and calculating the average of the obtained values.

(Measuring Method of Equivalent Circle Diameter)

The equivalent circle diameter of one crystalline polyester resin is a diameter of a circle having the same area to the area of the cross section of the sea of the crystalline polyester resin. The equivalent circle diameter of the crystalline polyester in the toner is obtained by determining an equivalent circle diameter of the domain of the crystalline polyester resin, on which the aspect ratio are calculated, and calculating the average of the determined values.

(Area Ratio)

The area ratio of a cross-section of the crystalline polyester resin in the toner to the cross-section of the entire toner particle is an average value of values obtained by calculating on 20 toner particles on which the aspect ratio has been calculated.

<Crystalline Poly Ester Resin (C)>

In the present invention, a crystalline polyester resin (C) containing a urethane bond and/or a urea bond in its principle chain is used.

In the present invention, a crystalline resin is a resin containing a segment having a crystal structure, and a diffraction spectrum thereof as obtained by means of an X-ray diffraction spectrometer has a diffraction peak derived from the crystal structure.

The crystalline resin has characteristics that it is sharply softened by application of heat, and a ratio (softening temperature/maximum peak temperature of heat of melting) of the softening temperature of the crystalline resin as measured by a capillary rheometer to the maximum peak temperature of heat of melting of the crystalline resin as measured by a differential scanning calorimeter (DSC) is 0.8 to 1.6.

Moreover, the non-crystalline resin for use in the present invention is a resin that does not have a crystal structure, and a diffraction spectrum thereof as measured by an X-ray diffraction spectrometer does not have a diffraction peak derived from a crystal structure. The non-crystalline resin has characteristics that it is gradually softened as heat is applied, and a ratio (softening temperature/maximum peak temperature of heat of melting) of the softening temperature of the non-crystalline resin to the maximum peak temperature of heat of melting of the non-crystalline resin is greater than 1.6.

The softening temperature of the resin can be measured by a capillary rheometer (e.g., CFT-500D (manufactured by Shimadzu Corporation)). While heating 1 g of a resin serving as a sample at the heating rate of 3° C./min, a load of 2.94 MPa was applied to the sample by a plunger, to extrude the sample from a nozzle having a diameter of 0.5 mm, and a length of 1 mm. A dropped amount of the plunger of the capillary rheometer to the temperature is plotted, and the temperature at which a half the amount of the sample is extruded is determined as softening temperature.

The maximum peak temperature of heat of melting of the resin can be measured by means of a differential scanning calorimeter (DSC) (differential scanning calorimeter Q2000 (manufactured by TA Instruments)). As for a pre-treatment, a sample that is provided to a measurement of the maximum peak temperature of heat of melting is melted at 130° C., followed by cooling to the sample from 130° C. to 70° C. at the rate of 1.0° C./min., and then is cooled from 70° C. to 10° C. at the rate of 0.5° C./min. Then, the sample of heated at the heating rate of 10° C./min to measure a variation in an endothermic and exothermic value by DSC, and a graph of "endothermic-exothermic value" and "temperature" is drawn. The endothermic peak temperature observed in the range of 20° C. to 100° C. is determined as "Ta*." In the case where there are a plurality of endothermic peaks, the temperature of the peak having the largest endothermic value is determined as Ta*. Thereafter, the sample is stored for 6 hours at (Ta*-10)° C., followed by storing for 6 hours at (Ta*−15)° C. Subsequently, the sample is cooled to 0° C. at the cooling rate of 10° C./min and then heated at the heating rate of 10° C./min by DSC to measure a variation in an endothermic and exothermic value, and a similar graph to the above is drawn. The temperature corresponding to the maximum peak of the endothermic value is determined as the maximum peak temperature of heat of melting.

As for the endothermic value of the toner or resin, the sample is heated from room temperature to 150° C. at the heating rate of 10° C./min, is left to stand for 10 minutes at 150° C., then is cooled to room temperature and left to stand for 10 minutes, and then is again heated to 150° C. at the heating rate of 10° C./min to perform the DSC measurement, and the area between the endothermic peak of the second heating and the base line is determined as the endothermic value.

An amount of the crystalline resin in the binder resin is preferably 50% by mass or greater in view of attaining both attaining low temperature fixing ability and heat resistant storage stability due to the crystalline resin, as much as possible, more preferably 65% by mass or greater, even more preferably 80% by mass or greater, and particularly preferably 95% by mass or greater. When the amount thereof is less than 50% by mass, sharp melting of the binder resin is not exhibited in viscoelastic properties of a resulting toner, and therefore it is difficult to attain both low temperature fixing ability and heat resistant storage stability.

Moreover, the ratio (C)/((C)±(A)) is preferably 0.15 or greater in view of both fixing ability and heat resistant stability of a resulting toner, more preferably 0.20 or greater, even more preferably 0.30 or greater, and particularly preferably 0.45 or greater, where (C) is an integrated intensity of part of a spectrum derived from a crystal structure, (A) is an integrated intensity of part of the spectrum derived from a non-crystal structure, and the spectrum is a diffraction spectrum of the binder resin as obtained by an X-ray diffraction spectrometer.

The ratio (C)/((C)+(A)) is an index for an amount of the crystalline unit in the binder resin, and is an area ratio of a main diffraction peak derived from the crystal structure to a halo in a diffraction spectrum of the binder resin as obtained by X-ray diffraction spectroscopy. In the to present invention, X-ray diffraction spectroscopy is performed by means of an X-ray diffractometer equipped with a 2D detector (D8 DISCOVER with GADDS, of Bruker Japan).

As for a capillary tube for use in the measurement, a marked tube (Lindemann glass) having a diameter of 0.70 mm is used. A sample is loaded in the capillary tube up to the top of the capillary tube to carry out the measurement. At the time when the sample is loaded, tapping is performed, and a number of taps is 100 times. Specific conditions for the measurement are as follows:

Tube current: 40 mA
Tube voltage: 40 kV
Goniometer 2θ axis: 20.0000°
Goniometer Ω axis: 0.0000°
Goniometer ϕ axis: 0.0000°
Detector distance: 15 cm (wide angle measurement)
Measuring range: 3.2≤2θ(°)≤37.2
Measuring time: 600 sec As for an incident optical system, a collimator having a pin hole having a diameter of 1 mm is used. The obtained 2D data was integrated using the supplied software (x axis: 3.2° to 37.2°) to invert the 2D data into 1D data of diffraction intensity and 2θ.

A method for calculating the ratio (C)/((C)+(A)) based on the result obtained from the D-ray diffraction spectroscopy is explained hereinafter. Examples of the diffraction spectrums obtained by X-ray diffraction spectroscopy are presented in FIGS. 1A and 1B. The horizontal axis represents 2θ, the longitudinal axis represents X-ray diffraction intensity, and both are linear axes.

Figure 1B:
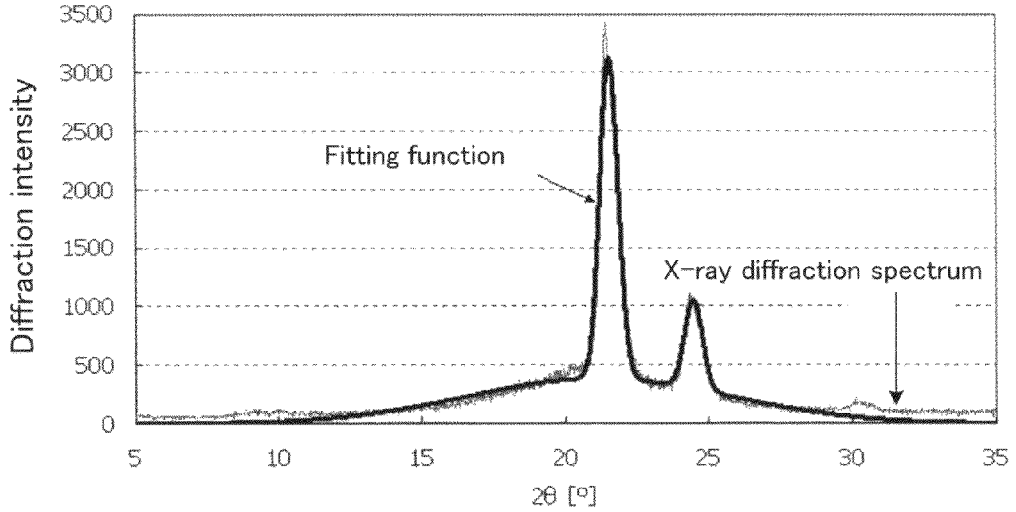
FIG. 1B is a diagram depicting one example of a fitting function of a while X-ray diffraction spectrum.

In the X-ray diffraction spectrum of FIG. 1A, the main peaks (P1, P2) are appeared at 2θ=21.3°, 24.2°, and the halo (h) is appeared in the wide range including these two peaks. The main peaks are derived the crystalline structure, and the halo is derived from the non-crystalline structure. The two main peaks, and halo are respectively represented with Gaussian functions of the following formulae A(1) to A(3).

$$fp1(2\theta)=ap1\exp\{-(2\theta-bp1)^2/(2cp1^2)\} \quad \text{Formula A(1)}$$

$$fp2(2\theta)=ap2\exp\{-(2\theta-bp2)^2/(2cp2^2)\} \quad \text{Formula A(2)}$$

$$fh(2\theta)=ah\exp\{-(2\theta-bh)^2/(2ch^2)\} \quad \text{Formula A(3)}$$

In the formulae above, fp1(2θ), fp2(2θ), fh(2θ) are functions corresponding to the main peaks P1, P2, and halo, respectively.

Then, the following formula A(4) represented as a sum of these three functions is used as a fitting function (depicted in FIG. 1B) of the entire X-ray diffraction spectrum, and fitting is performed by the least-squares method.

$$f(2\theta)=fp1(2\theta)+fp2(2\theta)+fh(2\theta) \quad \text{Formula A(4)}$$

The variables for the fitting are 9 variables, i.e., ap1, bp1, cp1, ap2, bp2, cp2, ah, bh, and ch. As for a fitting initial value of each variable, peak positions of X-ray diffraction (bp1=21.3, bp2=24.2, bh=22.5, in the examples depicted in FIGS. 1A and 1B) are set for bp1, bp2, and bh, and for other variables, values are appropriately assigned, and the values with which the two main peaks and halo are matched to the X-ray diffraction spectrum as close as possible are set as the fitting initial values of the aforementioned other variables.

The fitting can be performed, for example, using a solver, Excel 2003, of Microsoft Corporation.

The ratio (C)/((C)+(A)), which is an index for an amount of the crystalline segments, can be calculated from the integrated areas (SP1, Sp2, Sh) of Gaussian functions fp1(2θ) and fp2(2θ), which are corresponded to the two main peaks after the fitting (P1, P2), and Gaussian function fh(2θ), which is corresponded to the halo, where (Sp1+Sp2) is determined as (C), and Sh is determined as (A).

The maximum peak temperature of heat of melting of the crystalline resin is preferably 50° C. to 70° C. in view of both low temperature fixing ability and heat resistant storages stability of a resulting toner, more preferably 55° C. to 68° C., and particularly preferably 60° C. to 65° C. When the maximum peak temperature is lower than 50° C., low temperature fixing ability of a toner is desirable, but heat resistant storage stability thereof is insufficient. When the maximum peak temperature thereof is higher than 70° C., on the other hand, heat resistant storage stability of a toner is desirable, but low temperature fixing ability thereof is insufficient.

The ratio (softening temperature/maximum peak temperature of heat of melting) of the softening temperature of the crystalline resin to the maximum peak temperature of heat of melting of the crystalline resin is 0.8 to 1.6, preferably 0.8 to 1.5, more preferably 0.8 to 1.4, and particularly preferably 0.8 to 1.3. As the value of the ratio is smaller, the resin has characteristics that the resin is sharply softened, and it is more excellent in view of both low temperature fixing ability and heat resistant storage stability of a resulting toner.

The weight average molecular weight (Mw) of the crystalline resin is preferably 2,000 to 100,000, more preferably 5,000 to 60,000, and even more preferably 8,000 to 30,000, in view of fixing ability of a resulting toner. When the weight average molecular weight thereof is smaller than 2,000, hot offset resistance of a resulting toner tends to be insufficient. When the weight average molecular weight thereof is greater than 100,000, low temperature fixing ability of a resulting toner tends to be insufficient.

In the present invention, the weight average molecular weight (Mw) of the resin can be measured by means of a gel permeation chromatography (GPC) measuring device (e.g., GPC-8220GPC, manufactured by Tosoh Corporation). As for a column, for example, TSKgel Super HZM-H, 15 cm, three connected columns (of Tosoh Corporation) are used. A resin to be measured is formed into a 0.15% solution with tetrahydrofuran (THF) (containing a stabilizer, manufactured by Wako Chemical Industries, Ltd.), the obtained solution is filtered with a filter having an opening size of 0.2 μM, and the filtrate is used as a sample. The THF sample solution (100 μL) is injected into the measuring device, and the measurement is performed in the environment having the temperature of 40° C. at the flow rate of 0.35 mL/min. For the measurement of the molecular weight of the sample, a molecular weight of the sample is calculated from the relationship between the logarithmic value of the calibration curve prepared from a several monodisperse polystyrene standard samples and the number of counts. As for the monodisperse polystyrene standard sample, Showdex STANDARD Std. Nos. S-7300, S-210, S-390, S-875, S-1980, S-10.9, S-629, S-3.0, and S-0.580 of SHOWA DENKO K.K., and toluene are used. As the detector, a refractive index (RI) detector is used.

The "crystalline polyester resin (C)" for use in the present invention is a resin containing a crystalline polyester unit. Specifically, the resin containing a crystalline polyester unit is 50% by mass or greater, preferably 60% by mass or greater, more preferably 75% by mass or greater, and even more preferably 90% by mass or greater, of the whole binder resin. This is because the larger the amount of the resin containing a crystalline polyester unit, more excellent low temperature fixing ability of the toner is. Specific examples thereof include a resin composed only of a resin containing a crystalline polyester unit (e.g., a unmodified crystalline polyester resin), a resin in which a crystalline polyester unit is linked, and a resin in which a crystalline polyester unit and another polymer are bonded (so-called a block polymer, and a graft polymer). A large part of the resin composed of only a crystalline polyester unit has a crystal structure, but the resin composed of only a crystalline polyester resin tends to be easily deformed by external force.

The reasons thereof are considered as follows. It is difficult to crystallize the entire part of the crystalline polyester, and the part where it is not crystallized (amorphous segment) is easily deformed as a degree of freedom of molecular chains thereof is high. Even in the part having a crystal structure, a high-order structure thereof is typically so-called a lamella structure where planes are formed by folding a molecular chain, and the planes are laminated. As a large bonding force does not word between lamella layers, the lamella layers are easily dislocated. If the binder resin for a toner is easily deformed by external force, problems may occur, such as deformation and aggregation of the toner in an image forming apparatus, deposition or adhesion of the toner to a member, and a tendency that a finally output image is damaged. Therefore, the binder resin needs to be resistant to deformation to some degree upon application of external force, and to have toughness.

In view of giving toughness to the resin, preferred are a resin, in which a crystalline polyester unit having a urethane bond segment, a urea bond segment, or a phenylene segment, which has large aggregation energy, is bonded, and a resin in which a crystalline polyester unit and another polymer are bonded (so-called a block polymer, and graft polymer). Among them, the resin, in which a crystalline polyester unit having a urethane bond segment or a urea bond segment is bonded is particularly preferable, as the presence of the urethane bond segment or urea bond segment in a molecular chain is considered to form an apparent crosslink point at the amorphous segment or between lamella layers due to large intermolecular force, and the resin is wettable to paper even after fixing to paper to enhance fixing strength.

<Crystalline Polyester Unit>

Examples of the crystalline polyester unit include a polycondensation polyester unit synthesized from polyol and polycarboxylic acid, a lactone ring-opening polymerization product, polyhydroxycarboxylic acid. Among them, a polycondensation polyester unit synthesized from diol and dicarboxylic acid is preferably in view of exhibition of crystallinity.

—Polyol—

Examples of the polyol include diol, and trihydric to octahydric or higher polyol.

The diol is appropriately selected depending on the intended purpose without any limitation, and examples thereof include: aliphatic diol, such as straight-chain aliphatic diol, and branched-chain aliphatic diol; C4-C36 alkylene ether glycol; C4-C36 alicyclic diol; alkylene oxide of the alicyclic diol ("alkylene oxide" may be referred to as "AO" hereinafter); bisphenol AO adduct; polylactone diol; polybutadiene diol; diol containing a carboxyl group; diol containing a sulfonic acid group or a sulfamic acid group; and diol containing another functional group, such as a salt thereof. Among them, aliphatic diol in which a number of carbon atoms in a chain thereof is 2 to 36 is preferable, and straight-chain aliphatic diol in which a number of carbon atoms in a chain thereof is 2 to 36 is more preferable. These may be used alone, or in combination.

An amount of the straight-chain aliphatic diol in the all diols is preferably 80 mol % or greater, more preferably 90 mol % or greater. The amount thereof being 80 mol % or greater is advantageous, because crystallinity of a resulting resin improves, both low temperature fixing ability and heat resistant storage stability are desirably achieved, and the resin hardness tends to improve.

The straight-chain aliphatic diol is appropriately selected depending on the intended purpose without any limitation, and examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among them, preferred are ethylene glycol, 1,3-propanediol, 1,4-butanediol, 1,6-hexanediol, 1,9-nonanediol, and 1,10-decanediol, as they are readily available.

The branched-chain aliphatic diol in which a number of carbon atoms in a chain thereof is 2 to 36 is appropriately selected depending on the intended purpose without any limitation, and examples thereof include 1,2-propylene glycol, butane diol, hexane diol, octane diol, decane diol, dodecane diol, tetradecane diol, neopentyl glycol, and 2,2-diethyl-1,3-propanediol.

The C4-C36 alkylene ether glycol is appropriately selected depending on the intended purpose without any limitation, and examples thereof include diethylene glycol, triethylene glycol, dipropylene glycol, polyethylene glycol, polypropylene glycol, and polytetramethylene ether glycol.

The C4-C36 alicyclic diol is appropriately selected depending on the intended purpose without any limitation, and examples thereof include 1,4-cyclohexane dimethanol, and hydrogenated bisphenol A.

The alkylene oxide (may be abbreviated as AO hereinafter) of the alicyclic diol is appropriately selected depending on the intended purpose without any limitation, and examples thereof include adducts (a number of moles added: 1 to 30) of ethylene oxide (may be abbreviated as EO hereinafter), propylene oxide (may be abbreviated as PO hereinafter), and butylenes oxide (may be abbreviated as BO hereinafter).

The bisphenol is appropriately selected depending on the intended purpose without any limitation, and examples thereof include AO (e.g., EU, PO, and BO) adducts (a number of moles added: 2 to 30) of bisphenol A, bisphenol F, or bisphenol S.

The polylactone diol is appropriately selected depending on the intended purpose without any limitation, and examples thereof include poly ϵ-caprolacone diol.

The diol containing a carboxyl group is appropriately selected depending on the intended purpose without any limitation, and examples thereof include C6-C24 dialkylol alkanoic acid, such as 2,2-dimethylol priopionic acid (DMPA), 2,2-dimethylol butanoic acid, 2,2-dimethylol heptanoic acid, and 2,2-dimethylol octanoic acid.

The diol containing a sulfonic acid group or sulfamic acid group is appropriately selected depending on the intended purpose without any limitation, and examples thereof include: sulfamic acid diol, such as N,N-bis(2-hydroxyethyl) sulfamic acid, and N,N-bis(2-hydroxyethyl)sulfamic acid PO (2 mol) adduct; N,N-bis(2-hydroxyalkyl)sulfamic acid (a number of carbon atoms in the alkyl group: 1 to 6) AO adduct (e.g., EO and PO, number of moles of AO added: 1 to 6); and bis(2-hydroxyethyl)phosphate.

The neutralized salt group contained in the diol having a neutralized salt group is appropriately selected depending on the intended purpose without any limitation, and examples thereof include C3-C30 tertiary amine (e.g., triethyl amine), and alkali metal (e.g., sodium salt).

Among them, the C2-C12 alkylene glycol, diol having a carboxyl group, an AO adduct of bisphenols, and any combination thereof are preferable.

Moreover, the trihydric to octahydric or higher polyol, which is optionally used, is appropriately selected depending on the intended purpose without any limitation, and examples thereof include: alkane polyol and intramolecular or intermolecular dehydrate thereof (e.g., glycerin, trimethylol ethane, trimethylol propane, pentaerythritol, sorbitol, sorbitan, and polyglycerin); C3-C36 trihydric to octahydric or higher polyhydric aliphatic alcohol such as saccharide and a derivative thereof (e.g., sucrose, and methyl glucoside); a trisphenol (e.g. trisphenol PA) AO adduct (a number of moles added: 2 to 30); a novolak resin (e.g., phenol novolak, and cresol novolak) AO adduct (a number of moles added: 2 to 30); and acryl polyol, such as a copolymer of hydroxyethyl(meth) acrylate and another vinyl-based monomer. Among them, preferred are trihydric to octahydric or higher polyhydric aliphatic alcohol and a novolak resin AO adduct, and more preferred is the novolak resin AO adduct.

—Polycarboxylic Acid—

Examples of the polycarboxylic acid include dicarboxylic acid, and trivalent to hexavalent or higher polycarboxylic acid.

The dicarboxylic acid is appropriately selected depending on the intended purpose without any limitation, and examples thereof include aliphatic dicarboxylic acid (e.g., straight-chain aliphatic dicarboxylic acid, and branched-chain aliphatic dicarboxylic acid), and aromatic dicarboxylic acid. Among them, preferred is straight-chain aliphatic dicarboxylic acid.

The aliphatic dicarboxylic acid is appropriately selected depending on the intended purpose without any limitation, and examples thereof include: C4-C36 alkane dicarboxylic acid, such as succinic acid, adipic acid, sebacic acid, azelaic acid, dodecane dicarboxylic acid, octadecane dicarboxylic acid, and decyl succinic acid; alkenyl succinic acid, such as dodecenyl succinic acid, pentadecenyl succinic acid, and octadecenyl succinic acid; C4-C36 alkene dicarboxylic acid, such as maleic acid, fumaric acid, and citraconic acid; and C6-C40 alicyclic dicarboxylic acid, such as dimmer acid (e.g., linoeic acid dimer).

The aromatic dicarboxylic acid is appropriately selected depending on the intended purpose without any limitation, and examples thereof include C8-C36 aromatic dicarboxylic acid, such as phthalic acid, isophthalic acid, terephthalic acid, t-butylisophthalic acid, 2,6-naphthalene dicarboxylic acid, and 4,4'-biphenyl dicarboxylic acid.

Moreover, examples of the optional trivalent to hexavalent or higher polycarboxylic acid include C9-C20 aromatic polycarboxylic acid, such as trimellitic acid, and pyromellitic acid.

Note that, as the dicarboxylic acid or trivalent to hexavalent or higher polycarboxylic acid, acid anhydrides or C1-C4 alkyl ester of the above-listed acids may be used. Examples of the C1-C4 alkyl ester include methyl ester, ethyl ester, and isopropyl ester.

Among the dicarboxylic acid, single use of the aliphatic dicarboxylic acid (preferably adipic acid, sebacic acid, dodecanedicarboxylic acid, terephthalic acid, or isophthalic acid) is particularly preferable. Similarly, use of a copolymer of the aliphatic dicarboxylic acid with the aromatic dicarboxylic acid (preferably terephthalic acid, isophthalic acid, t-butylisophthalic acid, or low alkyl ester thereof) is preferable. An amount of the aromatic dicarboxylic acid in the copolymer is preferably 20 mol % or less.

—Lactone Ring-Opening Polymerization Product—

The lactone ring-opening polymerization product is appropriately selected depending on the intended purpose without any limitation, and examples thereof include: a lactone ring-opening polymerization product obtained through ring-opening polymerization of lactone, such as C3-C12 monolactone (number of ester groups in a ring: one) (e.g., β-propiolactone, γ-butylolactone, δ-valerolactone, and ϵ-caprolactone) using a catalyst, such as metal oxide, and an organic metal compound; and a lactone ring-opening polymerization product having a hydroxyl group at a terminal thereof obtained through ring-opening polymerization of the C3-C12 monolactone using glycol (e.g., ethylene glycol, and diethylene glycol) as an initiator.

The C3-C12 monolactone is appropriately selected depending on the intended purpose without any limitation, but it is preferably ϵ-caprolactone in view of crystallinity.

The lactone ring-opening polymerization product may be selected from commercial products, and examples of the commercial products include highly crystalline polycaprolactone such as H1P, H4, H5, and H7 of PLACCEL series manufactured by Daicel Corporation.

—Polyhydroxycarboxylic Acid—

The preparation method of the polyhydroxycarboxylic acid is appropriately selected depending on the intended purpose without any limitation, and examples thereof include: a method in which hydroxycarboxylic acid such as glycolic acid, and lactic acid (e.g., L-lactic acid, D-lactic acid, and racemic lactic acid) is directly subjected to a dehydration-condensation reaction; and a method in which C4-C12 cyclic ester (the number of ester groups in the ring is 2 to 3), which is an equivalent to a dehydration-condensation product between 2 or 3 molecules of hydroxycarboxylic acid, such as glycolide or lactide (e.g., L-lactide acid, D-lactide, and racemic lactic acid) is subjected to a ring-opening polymerization using a catalyst such as metal oxide and an organic metal compound. The method using ring-opening polymerization is preferable because of easiness in adjusting a molecular weight of the resultant.

Among the cyclic esters listed above, L-lactide and D-lactide are preferable in view of crystallinity. Moreover, terminals of the polyhydroxycarboxylic acid may be modified to have a hydroxyl group or carboxyl group.

<Crystalline Polyester Unit-Linked Resin>

Examples of a method for obtaining a resin, in which a crystalline polyester unit is linked include a method containing producing a crystalline polyester resin containing an active hydrogen, such as a hydroxyl group, at a terminal thereof in advance, and linking the crystalline polyester unit with polyisocyanate. In accordance with this method, a urethane bond site can be introduced into a skeleton of a resin, and therefore toughness of the resin can be enhanced.

Examples of the polyisocyanate include diisocyanate, and trivalent or higher polyisocyanate.

The diisocyanate is appropriately selected depending on the intended purpose without any limitation, and examples thereof include aromatic diisocyanate, aliphatic diisocyanate, alicyclic diisocyanate, and aromatic aliphatic diisocyanate. Among them, preferred are aromatic diisocyanate, in which a number of carbon atoms excluding carbon atoms in the NCO group is 6 to 20, aliphatic diisocyanate, in which the number of the carbon atoms are 2 to 18, alycyclic diisocyanate, in which the number of the carbon atoms are 4 to 15, aromatic aliphatic diisocyanate, in which the number of the carbon atoms are 8 to 15, modified products (modified product containing urethane group, carbodiimide group, allophanate group, urea group, biuret group, uretdione group, uretimine group, isocyanurate group, or oxazolidone group) of these diisocyanates, and a mixture thereof. Moreover, trivalent or higher isocyanate may be optionally used in combination.

The aromatic diisocyanate is appropriately selected depending on the intended purpose without any limitation, and examples thereof include 1,3-phenylene diisocyanate, 1,4-phenylene diisocyanate, 2,4-tolylene diisocyanate (TDI), 2,6-tolylene diisocyanate (TDI), crude TDI, 2,4'-diphenyl methane diisocyanate(MDI), 4,4'-diphenyl methane diisocyanate (MDI), crude MDI [a phosgenated product of crude diaminophenyl methane [a condensation product of formaldehyde and aromatic amine (aniline) or a mixture thereof; and a mixture of diaminodiphenyl methane, and a small amount (e.g., 5% by mass to 20% by mass) of trifunctional or higher polyamine], and polyaryl polyisocyanate (PAPP), 1,5-naphthylene diisocyanate, 4,4',4"-triphenylmethane triisocyanate, m-isocyanatophenylsulfonyl isocyanate, and p-isocyanatophenylsulfonyl isocyanate.

The aliphatic diisocyanate is appropriately selected depending on the intended purpose without any limitation, and examples thereof include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethylcaproate, bis(2-isocyanatoethyl)fumarate, bis(2-isocyanatoethyl)carbonate, and 2-isocyanatoethyl-2,6-diisocyanatohexanoate.

The alicyclic diisocyanate is appropriately selected depending on the intended purpose without any limitation, and examples thereof include isophorone diisocyanate (IPDI), dicyclohexylmethane-4,4'-diisocyanate (hydrogenated MDI), cyclohexylene diisocyanate, methylcyclohexylene diisocyanate (hydrogenated TDI), bis(2-isocyanatoethyl)-4-cyclohexene-1,2-dicarboxylate, 2,5-norbornanediisocyanate, and 2,6-norbornanediisocyanate.

The aromatic aliphatic diisocyanate is appropriately selected depending on the intended purpose without any limitation, and examples thereof include m-xylene diisocyanate (XDI), p-xylene diisocyanate (XDI), and α,α,α',α'-tetramethylxylene diisocyanate (TMXDI).

Moreover, the modified product of the diisocyanate is appropriately selected depending on the intended purpose without any limitation, and examples thereof include a modified product containing a urethane group, a modified product containing carbodiimide group, a modified product containing an allophanate group, a modified product containing a urea group, a modified product containing a biuret group, a modified product containing a uretdione group, a modified product containing a uretimine group, a modified product containing an isocyanurate group, and a modified product containing an oxazolidone group. Specific examples thereof include: a modified product of diisocyanate, such as modified MDI (e.g., urethane-modified MDI, carbodiimide-modified MDI, and trihydrocarbylphosphate-modified MDI), and urethane-modified TDI (e.g., isocyanurate-containing prepolymer); and a mixture of these modified products of the diisocyanate (e.g., a combination of modified MDI and urethane-modified TDI).

Among these diisocyanates, preferred are aromatic diisocyanate, in which a number of carbon atoms excluding carbon atoms in the NCO group is 6 to 15, aliphatic diisocyanate, in which the number of the carbon atoms is 4 to 12, and alicyclic diisocyanate, in which the number of the carbon atoms is 4 to 15. Particularly preferred are TDI, MDI, HDI, hydrogenated MDI, and IPDI.

<Resin where Crystalline Polyester Unit and Another Polymer are Bonded>

As for a method for obtaining a resin, in which the crystalline polyester unit and another polymer are bonded, there are a method, in which a crystalline polyester unit and another polymer unit are separately produced in advance, and these units are bonded, a method, in which either a crystalline polyester unit or another polymer unit is produced in advance, and the other polymer is polymerized in the presence of the produced unit to thereby bond these unit, and a method, in which a crystalline polyester unit and another polymer unit are concurrently or successively polymerized in the same reaction system to thereby obtain the resin. The first or second method is preferable as a reaction is easily controlled according to the intended design.

Examples of the first method include a method, in which a unit having active hydrogen, such as a hydroxyl group, at a terminal thereof is prepared in advance similarly to the aforementioned method for obtaining the resin in which the crystalline polyester unit is linked, and the unit is linked with polyisocyanate. As for the polyisocyanate, those listed in the description above can be used. Moreover, the polyisocyanate can be obtained by a method where an isocyanate group is introduced at a terminal of one unit, and the isocyanate group is allowed to react with active hydrogen of another unit. In accordance with this method, a urethane bond segment can be introduced in a skeleton of the resin, and therefore toughness of the resin can be enhanced.

As for the second method, in the case where a crystalline polyester unit is prepared first, and a polymer unit prepared next is a non-crystalline polyester unit, a polyurethane unit, or a polyurea unit, the resin in which the crystalline polyester unit and another polymer are bonded can be obtained by allowing a hydroxyl group or carboxyl group present at the terminal of the crystalline polyester unit to react with a monomer used to obtain another polymer unit.

<Non-Crystalline Polyester Unit>

Examples of the non-crystalline polyester unit include a polycondensation polyester unit synthesized from polyol and polycarboxylic acid. As for the polyol and the polycarboxylic acid, those listed in the descriptions of the crystalline polyester unit can be used. In order to design the unit not to have crystallinity, many folding points or branching points can be provided to a polymer skeleton. In order to give folding points, for example, bisphenol or a derivative thereof (e.g., AO (e.g., EO, PO, and BO) adduct (number of moles added: 2 to 30) of bisphenol A, bisphenol F, or bisphenol S) is used as the polyol, and phthalic acid, isophthalic acid, or t-butylisophthalic acid is used as the polycarboxylic acid. In order to introduce branching points, moreover, trihydric or higher polyol or trivalent or higher polycarboxylic acid can be used.

<Polyurethane Unit>

Examples of the polyurethane unit include a polyurethane unit synthesized from polyol (e.g., diol, and trihydric to octahydric or higher polyol) and polyisocyanate (e.g., diisocyanate, and trivalent or higher polyisocyanate). Among them, a polyurethane unit synthesized from the diol and the diisocyanate is preferable.

As for the diol and the trihydric to octahydric or higher polyol, those listed as the diol and the trihydric to octahydric or higher polyol in the description of the polyester resin can be used.

As for the diisocyanate and the trivalent or higher polyisocyanate, those listed as the diisocyanate and the trivalent or higher polyisocyanate above can be used.

<Polyurea Unit>

Examples of the polyurea unit include a polyurea unit synthesized from polyamine (e.g., diamine, and trivalent or higher polyamine), and polyisocyanate (e.g., diisocyanate, and trivalent or higher polyisocyanate).

The diamine is appropriately selected depending on the intended purpose without any limitation, and examples thereof include aliphatic diamine, and aromatic diamine. Among them, preferred are C2-C18 aliphatic diamine, and C6-C20 aromatic diamine. Moreover, the aforementioned trivalent or higher amine may be optionally used.

The C2-C18 aliphatic diamine is appropriately selected depending on the intended purpose without any limitation, and examples thereof include: C2-C6 alkylene diamine, such as ethylene diamine, propylene diamine, trimethylene diamine, tetramethylene diamine, and hexamethylene diamine; C4-C18 polyalkylene diamine, such as diethylene triamine, iminobispropyl amine, bis(hexamethylene)triamine, triethylene tetramine, tetraethylene pentamine, and pentaethylene hexamine; C1-C4 alkyl or C2-C4 hydroxyalkyl substitute of the alkylene diamine or the polyalkylene diamine, such as dialkylaminopropyl amine, trimethylhexamethylene diamine, aminoethyl ethanol amine, 2,5-dimethyl-2,5-hexamethylene diamine, and methyl iminobispropyl amine; C4-C15 alicyclic diamine, such as 1,3-diaminocyclohexane, isophorone diamine, menthane diamine, and 4,4'-methylene dicyclohexanediamine (hydrogenated methylene dianiline); C4-C15 heterocyclic diamine, such as piperazine, N-aminoethylpiperazine, 1,4-diaminoethylpiperazine, 1,4-bis(2-amino-2-methylpropyl)piperazine, and 3,9-bis(3-aminopropyl)-2,4,8,10-tetraoxaspiro[5,5]undecane; and C8-C15 aromatic ring-containing aliphatic amine, such as xylene diamine, and tetrachloro-p-xylene diamine.

The C6-C20 aromatic diamine is appropriately selected depending on the intended purpose without any limitation, and examples thereof include: unsubstituted aromatic diamine, such as 1,2-, 1,3-, or 1,4-phenylenediamine, 2,4' or 4,4'-diphenylmethanediamine, crude dophenylmethanediamine (polyphenyl polymethylene polyamine), diaminodiphenyl sulfone, benzidine, thiodianiline, bis(3,4-diaminophenyl)sulfone, 2,6-diaminopyridine, m-aminobenzyl amine, triphenylmethane-4,4',4"-triamine, and naphthylene diamine; aromatic diamine containing C1-C4 nucleus substituted alkyl group, such as 2,4- or 2,6-tolylenediamine, crude tolylene diamine, diethyltolylene diamine, 4,4'-diamino-3,3'-dimethyldiphenylmethane, 4,4'-bis(o-toluidine), dianisidine, diaminoditolylsulfone, 1,3-dimethyl-2,4-diamino benzene, 1,3-dimethyl-2,6-diamino benzene, 1,4-diisopropyl-2,5-diamino benzene, 2,4-diaminomesitylene, 1-methyl-3,5-diethyl-2,4-diamino benzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diaminodiphenyl ether, and 3,3',5,5'-tetraisopropyl-4,4'-diaminodiphenylsulfone; mixtures of isomers of the unsubstituted aromatic diamine and/or the aromatic diamine having C1-C4 nucleus substituted alkyl groups with various ratios; aromatic diamine having a nucleus substituted electron withdrawing group (e.g., halogen, such as Cl, Br, I, and F; an alkoxy group, such as a methoxy group, and an ethoxy group; and a nitro group), such as methylene bis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline; 4,4'-diamino-3,3'-dimethyl-5,5'-dibromodiphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylene bis(2-iodoaniline), 4,4'-methylene bis(2-bromoaniline), 4,4'-methylene bis(2-fluoroaniline), 4-aminophenyl-2-chloroaniline; and aromatic diamine having a secondary amino group (e.g., part of or entire primary amino groups of the unsabustituted aromatic diamine, aromatic diamine containing a C1-C4 nucleus substituted alkyl group, mixture of isomers thereof at various blending ratios, and aromatic diamine having nucleus substituted electron-withdrawing group is substituted with a secondary amino group using a lower alkyl group, such as a methyl group, and an ethyl group), such as 4,4'-di(methylamino)diphenylmethane, and 1-methyl-2-methylamino-4-amino benzene.

As for the diamine, other than those listed above, usable are polyamine polyamine, such as low molecular polyamide polyamine obtained by condensation of dicarboxylic acid (e.g., dimmer acid) and an excess amount (2 moles or greater per mole of acid) of the polyamine (e.g., the alkylene diamine, and the polyalkylene poly); and polyether polyamine, such as hydride of cyanoethylated product of plyether polyol (e.g., polyalkylene glycol).

Moreover, a compound obtained by capping the amino groups of the amino compound with a ketone compound may be used.

Among them, preferred is a polyurea unit synthesized from the diamine and the diisocyanate.

Examples of the diisocyanate and the trivalent or higher polyisocyanate include those listed as the diisocyanate and the trivalent or higher polyisocyanate earlier.

<Vinyl Polymer Unit>

The vinyl polymer unit is a polymer unit obtained through homopolymerization or copolymerization of a vinyl monomer. Examples of the vinyl monomer include the following (1) to (10):

[(1) Vinyl-Based Hydrocarbon]

Aliphatic vinyl-based hydrocarbon: alkene (e.g., ethylene, propylene, butene, isobutylene, pentene, heptene, diisobutylene, octene, dodecene, octadecene, and α-olefin other than the above), and alkadiene (e.g., butadiene, isoprene, 1,4-pentadiene, 1,6-hexadiene, and 1,7-octadiene).

Alicyclic vinyl-based hydrocarbon: mono- or dicycloalkene and alkadiene (e.g., such as cyclohexene, (di)cyclopentadiene, vinylcyclohexene, and ethylidene bicycloheptane), and terpene (e.g., pinene, limonene, and indene).

Aromatic vinyl-based hydrocarbon: styrene, and hydrocarbyl (e.g., alkyl, cycloalkyl, aralkyl and/or alkenyl) substituted products thereof (e.g., α-methyl styrene, vinyl toluene, 2,4-dimethyl styrene, ethyl styrene, isopropyl styrene, butyl styrene, phenyl styrene, cyclohexyl styrene, benzyl styrene, crotyl benzene, divinyl benzene, divinyl toluene, divinyl xylene, and trivinyl benzene), and vinyl naphthalene.

[(2) Carboxyl Group-Containing Vinyl Monomer and Salt Thereof]

Vinyl monomer containing a carboxyl group, such as C3-C30 unsaturated monocarboxylic acid, unsaturated dicarboxylic acid, anhydride thereof, and monoalkyl(C1-C24) ester thereof, [e.g., (meth)acrylic acid, maleic acid (anhydride), monoalkyl maleate, fumaric acid, monoalkyl fumarate, crotonic acid, itaconic acid, monoalkyl itaconate, itaconic acid glycol monoether, citraconic acid, monoalkyl citraconate, and cinnamic acid].

[(3) Sulfone Group-Containing Vinyl Monomer, Vinyl Sulfonic Acid Monoester, and Salts Thereof]

C2-C14 alkene sulfonic acid, such as vinyl sulfonic acid, (meth)allyl sulfonic acid, methylvinyl sulfonic acid, and styrene sulfonic acid;

C2-C24 alkyl derivatives thereof, such as α-methyl styrene sulfonic acid;

sulfo(hydroxy)alkyl-(meth)acrylate or (meth)acrylamide, such as sulfopropyl(meth)acrylate, 2-hydroxy-3-(meth)acryloxypropyl sulfonic acid, 2-(meth)acryloylamino-2,2-dimethylethane sulfonic acid, 2-(meth)acryloyloxyethane sulfonic acid, 3-(meth)acryloyloxy-2-hydroxypropane sulfonic acid, 2-(meth)acrylamide-2-methylpropane sulfonic acid, 3-(meth)acrylamide-2-hydroxypropane sulfonic acid, alkyl (C3-C18)allyl sulfosuccinic acid, sulfuric acid ester of poly (n=2 to 30)oxyalkylene (e.g., ethylene, propylene, and butylene alone, or in random form, or block form) mono(meth) acrylate [e.g., sulfuric acid ester of poly(n=5 to 15)oxypropylene monoacrylate], and sulfuric acid ester of polyoxyethylene polycyclic phenyl ether.

[(4) Phosphoric Acid Group-Containing Vinyl Monomer and Salt Thereof]

(Meth)acryloyloxyalkyl phosphoric acid monoester, such as 2-hydroxyethyl(meth)acryloyl phosphate, phenyl-2-acryloyloxyethyl phosphate; (meth)acryloyloxyalkyl(C1-C24) phosphoric acid (e.g., 2-acryloyloxyethyl phosphoric acid); and salts thereof.

Note that, examples of salts of (2) to (4) above include alkali metal salt (e.g., sodium salt, and potassium salt), alkali earth metal salt (e.g., calcium salt, and magnesium salt), ammonium salt, amine salt, and quaternary ammonium salt.

[(5) Hydroxyl Group-Containing Vinyl Monomer]

Hydroxy styrene, N-methylol (meth)acrylamide, hydroxyethyl(meth)acrylate, hydroxypropyl(meth)acrylate, polyethylene glycol mono(meth)acrylate, (meth)aryl alcohol, crotyl alcohol, isocrotyl alcohol, 1-buten-3-ol, 2-buten-1-ol, 2-butene-1,4-diol, propargyl alcohol, 2-hydroxyethylpropenyl ether, and sucrose allyl ether.

[(6) Nitrogen-Containing Vinyl Monomer]

Amino group-containing vinyl monomer: aminoethyl (meth)acrylate, dimethylaminoethyl(meth)acrylate, diethylaminoethyl(meth)acrylate, t-butylaminoethyl methacrylate, N-aminoethyl(meth)acryl amide, (meth)allyl amide, morpholinoethyl(meth)acrylate, 4-vinylpyridine, 2-vinylpyridine, crotyl amine, N,N-dimethylamino styrene, methyl-α-acetoaminoacrylate, vinyl imidazole, N-vinyl pyrrole, N-vinylthiopyrrolidone, N-arylphenylene diamine, aminocarbazole, aminothiazole, aminoindole, aminopyrrole, aminoimidazole, aminomercaptothiazole, and salts thereof.

Amide group-containing vinyl monomer; (meth)acrylamide, N-methyl(meth)acrylpyridine, 2-vinylpyridine, crotyl amine, N,N-dimethylamino styrene, methyl-α-acetoaminoacrylate, vinyl imidazole, N-vinyl pyrrole, N-vinylthiopyrrolidone, N-arylphenylene diamine, aminocarbazole, aminothiazole, aminoindole, aminopyrrole, amino imidazole, aminomercaptothiazole, and salts thereof, acryl amide, N-butylacrylamide, diacetone acrylamide, N-methylol (meth) acrylamide, N,N-methylene-bis(meth)acrylamide, cinnamic acid amide, N,N-dimethylacrylamide, N,N-dibenzylacrylamide, methacryl formamide, N-methyl-N-vinylacetoamide, and N-vinylpyrrolidone.

Nitrile group-containing vinyl monomer: (meth)acrylonitrile, cyanostyrene, and cyanoacrylate.

Quaternary ammonium cation group-containing vinyl monomer: dimethylaminoethyl(meth)acrylate, diethylaminoethyl(meth)acrylate, dimethylaminoethyl(meth)acrylamide, diethylaminoethyl(meth)acrylamide, and a quaternized product of tertiary amine (e.g. diallyl amine) group-containing vinyl monomer (e.g., a compound quaternized using a quaternization agent, such as methyl chloride, dimethyl sulfate, benzyl chloride, and dimethyl carbonate).

Nitro group-containing vinyl monomer: nitro styrene.

[(7) Epoxy Group-Containing Vinyl Monomer]

Glycidyl(meth)acrylate, tetrahydrofurfuryl(meth)acrylate, and p-vinylphenyl phenyloxide.

[(8) Vinyl Ester, Vinyl (Thio) Ether, Vinyl Ketone, and Vinyl Sulfone]

Vinyl ester, such as vinyl acetate, vinyl butylate, vinyl propionate, vinyl butyrate, diallyl phthalate, diallyl adipate, isopropenyl acetate, vinyl methacrylate, methyl-4-vinyl benzoate, cyclohexyl methacrylate, benzyl methacrylate, phenyl (meth)acrylate, vinylmethoxy acetate, vinyl benzoate, ethyl-α-ethoxy acrylate, alkyl(meth)acrylate containing C1-C50 alkyl group [e.g., methyl(meth)acrylate, ethyl(meth)acrylate, propyl(meth)acrylate, butyl(meth)acrylate, 2-ethylhexyl (meth)acrylate, dodecyl(meth)acrylate, hexadecyl(meth) acrylate, heptadecyl(meth)acrylate, and eicosyl(meth)acrylate], dialkyl fumarate (two alkyl groups are C2-C8 straight or branched chain or alicyclic alkyl groups), dialkyl maleate (two alkyl groups are C2-C8 straight or branched chain or alicyclic alkyl groups), poly(meth)allyloxy alkane [e.g., diallyloxy ethane, triallyloxy ethane, tetraallyloxy ethane, tetraallyloxy propane, tetraallyloxy butane, and tetramethallyloxy ethane], a vinyl monomer having a polyalkylene glycol chain [e.g., polyethylene glycol (molecular weight: 300) mono(meth)acrylate, polypropylene glycol (molecular weight: 500) monoacrylate, methyl alcohol ethylene oxide (10 mol) adduct (meth)acrylate, and lauryl alcohol ethylene oxide (30 mol) adduct (meth)acrylate], poly(meth)acrylate [e.g., poly(meth)acrylate of polyhydric alcohol, such as ethylene glycol di(meth)acrylate, propylene glycol di(meth) acrylate, neopentyl glycol di(meth)acrylate, trimethylol propane tri(meth)acrylate, and polyethylene glycol di(meth) acrylate].

Vinyl (thio)ether, such as vinylmethyl ether, vinylethyl ether, vinylpropyl ether, vinyl butyl ether, vinyl-2-ethyl hexyl ether, vinylphenyl ether, vinyl-2-methoxyethyl ether, methoxy butadiene, vinyl-2-butoxy ethyl ether, 3,4-dihydro-1,2-pyran, 2-butoxy-2'-vinyloxydiethyl ether, vinyl-2-ethylmercaptoethyl ether, acetoxy styrene, and phenoxy styrene.

Vinyl ketone, such as vinyl methyl ketone, vinyl ethyl ketone, and vinyl phenyl ketone.

Vinyl sulfone, such as divinyl sulfide, p-vinyldiphenyl sulfide, vinylethyl sulfide, vinylethyl sulfone, divinyl sulfone, and divinyl sulfoxide.

[(9) Other Vinyl Monomers]

Isocyanate ethyl(meth)acrylate, and m-isopropenyl-α,α-dimethylbenzylisocyanate.

[(10) Fluorine Atom-Containing Vinyl Monomer]

4-fluoro styrene, 2,3,5,6-tetrafluoro styrene, pentafluorophenyl (meth)acrylate, pentafluorobenzyl(meth)acrylate, perfluorocyclohexyl(meth)acrylate, perfluorocyclohexyl methyl(meth)acrylate, 2,2,2-trifluoroethyl(meth)acrylate, 2,2,3,3-tetrafluoropropyl(meth)acrylate, 1H,1H,4H-hexafluorobutyl(meth)acrylate, 1H,1H,5H-octafluoropentyl (meth)acrylate, 1H,1H,7H-dodecafluoroheptyl(meth)acrylate, perfluorooctyl(meth)acrylate, 2-perfluorooctyl ethyl (meth)acrylate, heptadecafluorodecyl(meth)acrylate, trihydroperfluoroundecyl(meth)acrylate, perfluoronorbornylmethyl(meth)acrylate, 1H-perfluoroisobornyl(meth) acrylate, 2-(N-butylperfluorooctane sulfoamide)ethyl(meth) acrylate, 2-(N-ethylperfluorooctane sulfoamide)ethyl(meth) acrylate, and a corresponding compound derived from α-fluoroacrylic acid, bis-hexafluoroisopropyl itaconate, bis-hexafluoroisopropyl maleate, bis-perfluorooctyl itaconate, bis-perfluorooctyl maleate, bis-trifluoroethyl itaconate, bis-trifluoroethyl maleate, vinyl heptafluorobutylate, vinyl perfluoroheptanoate, vinyl perfluorononanate, and vinyl perfluorooctanoate.

<Crystalline Resin Containing Urea Bond in Principle Chain Thereof≤

Moreover, the binder resin preferably contains a crystalline resin containing a urea bond in a principle chain thereof.

In accordance with Solubility Parameter Values (Polymer handbook 4th Ed), the cohesive energy of the urea bond is 50,230 [J/mol], which is about twice the cohesive energy (26,370 [J/mol]]) of a urethane bond. Therefore, it is expected that use of such a resin even in a small amount can improve toughness or offset resistance of the toner during fixing.

In order to obtain the resin containing a urea bond in its principle chain, a polyisocyanate compound and a polyamine compound are allowed to react, or the polyisocyanate compound and water are allowed to react, and amino groups generated by hydrolysis of isocyanate and remaining isocyanate groups are allowed to react. In the production of the resin containing a urea bond in its principle chain, other than the compounds mentioned above, a polyol compound is allowed to react at the same time, to thereby widen a degree of freedom in designing of a resin.

<<<Polyisocyanate>>>

As for the polyisocyanate, other than the aforementioned diisocyanate, and trivalent or higher polyisocyanate (may be referred to as low molecular weight polyisocyanate hereinafter), a polymer having an isocyanate group at a terminal or side chain thereof (may be referred to as a prepolymer hereinafter) may be used.

Examples of a preparation method of the prepolymer include: a method, in which a low molecular weight polyisocyanate and a polyamine compound described later are allowed to react with an excess amount of isocyanate to thereby obtain a polyurea prepolymer having an isocyanate group at a terminal thereof; and a method, in which low molecular weight polyisocyanate and a polyol compound are allowed to react with an excess amount of isocyanate to thereby obtain a prepolymer containing an isocyanate group at a terminal thereof. The prepolymer obtained in any of these methods may be used alone, or two or more prepolymers obtained in the same method, or two or more prepolymers obtained by the two different methods may be used in combination. Moreover, the prepolymer and one, or two or more types of low molecular weight polyisocyanate may be used in combination.

A ratio of the polyisocyanate for use is determined as an equivalent ratio [NCO]/[$NH_2$] of isocyanate groups [NCO] to amino groups [$NH_2$] of polyamine, or an equivalent ratio [NCO]/[OH] of isocyanate groups [NCO] to hydroxyl groups [OH] of polyol, which is typically 5/1 to 1.01/1, preferably 4/1 to 1.2/1, and more preferably 2.5/1 to 1.5/1. When the molar ratio of [NCO] is grater than 5, urethane bones or urea bonds therein are excessive, and therefore elastic modulus of a melted toner is too high as a resulting resin is used as a binder resin of the toner, leading to poor fixing ability of the toner. When the molar ratio of [NCO] is less than 1.01, degree of polymerization becomes high and a molecular weight of a generated prepolymer is large, and therefore it is difficult to mix the prepolymer with other materials in the production of a toner, or elastic modulus of a melted toner becomes too high, which may lead to poor fixing ability of the toner. Therefore, such ranges of molar ratios are not preferable.

<<<Polyamine>>>

Examples of the polyamine include the aforementioned diamine, and aforementioned trivalent or higher polyamine.

<<<Polyol>>>

As for the polyol, other than the aforementioned diol, and trihydric to octahydric or higher polyol (may be referred to as low molecular weight polyol hereinafter), a polymer containing a hydroxyl group at a terminal or in a side chain thereof (may be referred to as high molecular weight polyol) may be used.

Examples of a preparation method of the high molecular weight polyol include: a method where low molecular weight polyisocyanate and low molecular weight polyol are allowed to react with an excessive amount of hydroxyl groups to thereby obtain polyurethane having a hydroxyl group at a terminal thereof; and a method where polycarboxylic acid and a low molecular weight polyol compound are allowed to react with an excessive amount of hydroxyl groups to thereby obtain polyester having a hydroxyl group at a terminal thereof.

In order to adjust the polyurethane or polyester having a hydroxyl group at a terminal thereof, a ratio [OH]/[NCO] of low molecular weight polyol to low molecular weight polyisocyanate, or a ratio [OH]/[COOH] of low molecular weight polyol to polycarboxylic acid is typically 2/1 to 1/1, preferably 1.5/1 to 1/1, and more preferably 1.3/1 to 1.02/1.

When the molar ratio of the hydroxyl group is grater than 2, the polymerization reaction is not progressed so that target high molecular weight polyol may not be attained. When the molar ratio of the hydroxyl group is less than 1.02, a degree of polymerization becomes high, and a molecular weight of high molecular weight polyol becomes too large, and therefore it may be difficult to mix with other materials in the production of a toner, or elastic modulus of a melted toner becomes too high, which may lead to poor fixing ability of the toner. Therefore, such ranges of molar ratios are not preferable.

<<<Polycarboxylic Acid>>>

Examples of the polycarboxylic acid include the aforementioned dicarboxylic acid, and the aforementioned trivalent to hexavalent or higher polycarboxylic acid.

<<<Crystalline Resin Containing Urea Bond in Principle Chain>>>

In order to give crystallinity to the obtained resin, a polymer unit having crystallinity in a principle chain thereof can be introduced into the resin. As for a crystalline polyester unit having a melting point suitable as a binder resin for a toner, there are a crystalline polyester unit, and a long-chain alkyl ester unit of polyacrylic acid or polymethacrylic acid. Among them, the crystalline polyester unit is preferable, as a unit having alcohol at a terminal can be easily produced, and it can be easily introduced as the polyol compound into a resin containing a urea bond.

Examples of the crystalline polyester unit include a polycondensation polyester unit synthesized from polyol and polycarboxylic acid, a lactone ring-opening polymerization product, and polyhydroxycarboxylic acid. Among them, a polycondensation polyester unit synthesized from diol and dicarboxylic acid is preferable in view of exhibition of crystallinity.

As for the diol those listed as diol in the description of the polyol can be used. Among them, aliphatic diol, in which a number of carbon atoms in a chain thereof is 2 to 36, is preferable, and straight-chain aliphatic diol is more preferable. These may be used alone, or in combination.

Among them, preferred are ethylene glycol, 1,3-propanediol, 1,4-butanediol, 1,6-hexanediol, 1,9-nonanediol, and 1,10-decanediol, in view of readily availability.

An amount of the straight chain aliphatic diol in the entire diols is preferably 80 mol % or greater, more preferably 90 mol % or greater. The amount thereof being 80 mol % or greater is preferable because crystallinity of the resin improves, both low temperature fixing ability and heat resistant storage stability are desirably achieved, and hardness of the resin tends to improve.

As for the dicarboxylic acid, those listed as the dicarboxylic acid in the description of the polycarboxylic acid can be used. Among them, to straight-chain aliphatic dicarboxylic acid is more preferable.

Among the dicarboxylic acid, single use of the aliphatic dicarboxylic acid (preferably, adipic acid, sebacic acid, dodecane dicarboxylic acid, terephthalic acid, and isophthalic acid) is particularly preferable. Similarly, a copolymer of the aliphatic dicarboxylic acid and the aromatic dicarboxylic acid (preferably terephthalic acid, isophthalic acid, and t-butylisophthalic acid, and lower alkyl ester of any of these aromatic dicarboxylic acids) is also preferably used. The copolymerization amount of the aromatic dicarboxylic acid is preferably 20 mol % or less.

<<<Introduction of Crystalline Resin Containing Urea Bond in Principle Chain into Toner>>>

A toner can be obtained by using a resin, to which a urea bond is formed in advance, as a binder resin, mixing the binder resin with other toner constituting materials, such as colorant, releasing agent, and charge controlling agent, and granulating the mixture. However, a urea bond may be formed by mixing a polyisocyanate compound, a polyamine compound and/or water, and optionally the toner constituting materials other than the binder resin, such as a colorant, releasing agent, and charge controlling agent. A high molecular weight crystalline resin containing a urea bond can be uniformly introduced into a toner especially by using a prepolymer as the polyisocyanate compound, and therefore a resulting toner has uniform thermal properties and charging properties, and both fixing ability and stress resistance of the toner can be attained. Therefore, use of the prepolymer is preferable. Moreover, the prepolymer is preferably a prepolymer obtained by allowing low molecular weight polyisocyanate and a polyol compound to react with an excessive amount of the isocyanate, as viscoelasticity is suppressed. The polyol compound is preferably polyester containing a hydroxyl group at a terminal thereof obtained by allowing polycarboxylic acid and a low molecular weight polyol compound with an excessive amount of hydroxyl groups, because thermal properties suitable for a toner can be attained. In the case where the polyester is composed of a crystalline polyester unit, it is preferable as a high molecular weight component of the toner exhibits sharp melting, and a toner having excellent low temperature fixing ability can be attained.

In the case where the toner of the present invention is obtained by granulating in an aqueous medium, moreover, a urea bond can be formed under mild conditions, as water serving as a dispersion medium reacts with the polyisocyanate compounds.

In the present invention, the binder resin may be used alone, or in combination. Moreover, the binder resins having different weight average molecular weights may be used in combination. It is preferred that the binder resin contain at least a first crystalline resin, and a second crystalline resin having the larger weight average molecular weight Mw than that of the first crystalline resin, as both excellent low temperature fixing ability and hot offset resistance can be attained.

Moreover, the second crystalline resin is preferably obtained by using the crystalline resin precursor that is a modified crystalline resin containing an isocyanate group, and allowing the modified crystalline resin to react with a compound containing an active hydrogen group to elongate the resin. In this case, the reaction of the binder resin precursor and the compound containing an active hydrogen group is preferably performed during the production process of a toner. As a result of this, the binder resin having a large weight average molecular weight can be homogeneously dispersed in a toner, and variations in properties between toner particles can be prevented.

Furthermore, it is preferred that the first crystalline resin be a crystalline resin containing a urethane bond and/or urea bond in a principle chain thereof, and the second crystalline resin be obtained by allowing the binder resin precursor, which is obtained by modifying the first crystalline resin, to react with a compound containing an active hydrogen group, to thereby elongate the resin. By making the composition structures of the first crystalline resin and the second crystalline resin similar, these two types of the binder resins can be homogeneously dispersed in the toner, and variations in properties between toner particles can be suppressed even further.

As for the crystalline resin, the crystalline resin and a non-crystalline resin may be used in combination. It is preferred that a main component of a binder resin be the crystalline resin.

<Non-Crystalline Polyester Resin (A)>

Examples of the non-crystalline polyester resin (A) include a ring-opening polymerization product of lactone, a polycondensation product of hydroxycarboxylic acid, and a polycondensation product of polyol and polycarboxylic acid. Among them, a polycondensation product of polyol and polycarboxylic acid is preferable in view of freedom in designing.

A peak molecular weight of the non-crystalline polyester resin (A) is typically 1,000 to 30,000, preferably 1,500 to 10,000, and even more preferably 2,000 to 8,000. When the peak molecular weight thereof is smaller than 1,000, heat resistant storage stability of a resulting toner is insufficient. When the peak molecular weight thereof is greater than 30,000, low temperature fixing ability of a resulting toner is poor for use as a toner for developing an electrostatic latent image.

<Polyol>

Examples of the polyol (1) include diol (1-1), and trihydric or higher polyol (1-2). Preferred are (1-1) alone, and a mixture of (1-1) and a small amount of (1-2).

Examples of the diol (1-1) include: alkylene glycol (e.g., ethylene glycol, 1,2-propylene glycol, 1,3-propylene glycol, 1,4-butanediol, 1,6-hexanediol); alkylene ether glycol (e.g., ethylene glycol, triethylene glycol, dipropylene glycol, polyethylene glycol, polypropylene glycol, and polytetramethylene ether glycol); alicyclic diol (e.g., 1,4-cyclohexane dimethanol, and hydrogenated bisphenol A); bisphenol (e.g., bisphenol A, bisphenol F, and bisphenol S); alkylene oxide (e.g., ethylene oxide, propylene oxide, and butylene oxide) adduct of the alicyclic diol; 4,4'-dihydroxybiphenyl, such as 3,3'-difluoro-4,4'-dihydroxybiphenyl; bis(hydroxyphenyl)alkane, such as bis(3-fluoro-4-hydroxyphenyl) methane, 1-phenyl-1,1-bis(3-fluoro-4-hydroxyphenyl)ethane, 2,2-bis(3-fluoro-4-hydroxyphenyl)propane, 2,2-bis(3,5-difluoro-4-hydroxyphenyl)propane (synonym: tetrafluorobisphenol A), and 2,2-bis(3-hydroxyphenyl)-1,1,1,3,3,3-hexafluoropropane; bis(4-hydroxyphenyl)ether, such as bis(3-fluoro-4-hydroxyphenyl)ether; and alkylene oxide (e.g., ethylene oxide, propylene oxide, and butylene oxide) adduct of the bisphenol.

Among them, preferred are C2-C12 alkylene glycol and an alkylene oxide adduct of bisphenol, and particularly preferred are the alkylene oxide adduct of bisphenol, and a combination of the alkylene oxide adduct of bisphenol and C2-C12 alkylene glycol.

Examples of the trihydric or higher polyol (1-2) include: trihydric to octahydric or higher polyhydric aliphatic alcohol (e.g., glycerin, trimethylol ethane, trimethylol propane, pentaerythritol, and sorbitol); trihydric or higher phenol (e.g., trisphenol PA, phenol novolak, and cresol novolak); and an alkylene oxide adduct of the trihydric or higher polyphenol.

In order to form a sea-island structure, as in the toner of the present invention, it is ideal to avoid a repeating unit having the similar to the structure of the crystalline polyester resin (C). In this point of view, as for preferable polyol among those listed above, preferred is use of alkylene glycol having a branched structure (e.g., 1,2-propylene glycol), or alicyclic diol (e.g., 1,4-cyclohexane dimethanol, and hydrogenated bisphenol A) as a main component in an amount of 90 mol % or greater relative to the entire polyol component.

Moreover, the skeleton derived from bisphenol, such as the one represented by the following general formula (1), tends to be relatively easily mixed with the crystalline polyester resin (C). Therefore, an amount of the polyol represented by the general formula (1) is preferably 0 mol % to 10 mol % relative to the polyol component constituting the non-crystalline polyester resin (A). It is more preferred that the polyol represented by the general formula (1) be not used.

$$HO—(R1\text{-}O)_n—C_6H_4—C(CH_3)_2—C_6H_4—(R2\text{-}O)_m—OH \qquad \text{General Formula (1)}$$

In the general formula (1), R1 and R2 are each a C2-C4 divalent saturated hydrocarbon linking group, and n and m are each a positive number of 1 to 2.

<Polycarboxylic Acid>

Examples of the polycarboxylic acid (2) include dicarboxylic acid (2-1) and trivalent or higher polycarboxylic acid (2-2), and preferred are (2-1) alone, and a mixture of (2-1) and a small amount of (2-2).

Examples of the dicarboxylic acid (2-1) include alkylene dicarboxylic acid (e.g., succinic acid, adipic acid, and sebacic acid), alkenylene dicarboxylic acid (e.g., maleic acid, and fumaric acid), aromatic dicarboxylic acid (e.g., phthalic acid, isophthalic acid, and naphthalene dicarboxylic acid), 3-fluoroisophthalic acid, 2-fluoroisophthalic acid, 2-fluoroterephthalic acid, 2,4,5,6-tetrafluoroisophthalic acid, 2,3,5,6-tetrafluoroterephthalic acid, 5-trifluoromethylisophthalic acid, 2,2-bis(4-carboxyphenyl)hexafluoropropane, 2,2-bis(3-carboxyphenyl)hexafluoropropane, 2,2'-bis(trifluoromethyl)-4,4'-biphenyldicarboxylic acid, 3,3'-bis(trifluoromethyl)-4,4'-biphenyldicarboxylic acid, 2,2'-bis(trifluoromethyl)-3,3'-biphenyldicarboxylic acid, and hexafluoroisopropylidene diphthalic acid anhydride. Among them, preferred are C4-C20 alkenylene dicarboxylic acid and C8-C20 aromatic dicarboxylic acid.

Examples of the trivalent or higher polycarboxylic acid (2-2) include C9-C20 aromatic polycarboxylic acid (e.g., trimellitic acid, and pyromellitic acid). Note that, as for the polycarboxylic acid (2), anhydride or lower alkyl ester (e.g., methyl ester, ethyl ester, and isopropyl ester) of any of the above-listed acids may be used to react with polyol (1).

In order to form a sea-island structure as in the toner of the present invention, among them, use of a repeating unit having the closer structure to the structure of the crystalline polyester resin (C) is preferably avoided. For example, an amount of alkylene dicarboxylic acid (e.g., succinic acid, adipic acid, and sebacic acid) for use is 50 mol % or less, preferably 90 mol % or less, relative to the entire polycarboxylic acid component.

In the case where mechanical strength of resulting color resin particles is enhanced, or resulting color resin particles are used as a toner for developing an electrostatic latent image, color resin particles may be obtained by dissolving a modified resin containing an isocyanate group at a terminal thereof for the purpose of preventing hot offset during fixing, in addition to the aforementioned enhancement of mechanical strength. Examples of a method for obtaining the modified resin include: a method where a polymerization reaction is carried out in the presence of a monomer containing an isocyanate group, to thereby obtain a resin containing an isocyanate group; and a method where, after obtaining a resin containing active hydrogen at a terminal thereof through polymerization, the obtained resin is allowed to react with polyisocyanate to thereby introduce an isocyanate group at a terminal of the polymer. The latter method is preferable in view of control for introducing an isocyanate group at a terminal. Examples of the active hydrogen include a hydroxyl group (e.g., an alcoholic hydroxyl group, and a phenolic hydroxyl group), an amino group, a carboxyl group, and a mercapto group. Among them, an alcoholic hydroxyl group is preferable. In view of uniformity of particles, a skeleton of the modified resin is preferably the same as that of the resin dissolved in an organic solvent, more preferably a polyester skeleton. As for a method for obtaining the resin containing an alcoholic hydroxyl group at a terminal of polyester, a polycondensation reaction of polyol and polycarboxylic acid can be carried out with the number of functional groups of the polyol being larger than the number of functional groups of the polycarboxylic acid.

Part of isocyanate groups of the modified resin becomes amino groups through hydrolysis caused in the process of dispersing an oil phase in an aqueous phase, and the generated amino groups are reacted with the remaining isocyanate groups to progress an elongation reaction. Other than the reaction mentioned above, the aforementioned amine compound can be used in combination for the purpose of surely performing an elongation reaction, or introducing crosslink points.

The glass transition temperature (Tg) of the non-crystalline polyester resin (A) for use is preferably 40° C. to 75° C., more preferably 50° C. to 65° C. When the glass transition temperature thereof is lower than 40° C., heat resistant storage stability of a resulting toner may be insufficient. When the glass transition temperature thereof is higher than 75° C., fixing ability of a resulting toner may be insufficient. As for the measurement of the glass transition temperature, for example, a differential scanning calorimeter (e.g., DSC-6220R, manufactured by Seiko instruments Inc.) can be used. First, a sample is heated from room temperature to 150° C. at the heating rate of 10° C./min, followed by leaving to stand for 10 minutes at 150° C. Then, the sample is cooled to room temperature, followed by leaving to stand for 10 minutes. Again, the sample is heated to 150° C. at the heating rate of 10° C./min. The glass transition temperature can be determined with an intersection point of a base line of equal to or lower than the glass transition temperature, and a tangent line of a curve segment indicating glass transition.

The production method of the toner of the present invention is not particularly limited, and examples thereof include a conventional wet granulation method (e.g., dissolution suspension, and emulsion aggregation), and a pulverization method. As molecular chains may cut by kneading and it is difficult to uniformly knead a high molecular weight resin and a low molecular weight resin, preferred are dissolution suspension and emulsion aggregation, which are the production methods that do not include kneading of a binder resin. In view of uniformity of the resins in the toner particles, dissolution suspension is particularly preferable.

[Dissolution Suspension]

First, toner materials, such as the colorant, the binder resin, and a releasing agent, are dispersed or dissolved in an organic solvent to thereby form a toner material liquid. Then, the toner material liquid is emulsified in an aqueous medium in the presence of the surfactant and resin particles, to thereby obtain particles.

(Organic Solvent)

The organic solvent is preferably volatile, and has a boiling point of lower than 100° C., because such organic solvent is easily removed after forming toner base particles. Specific examples thereof include toluene, xylene, benzene, carbon tetrachloride, methylene chloride, 1,2-dichloroethane, 1,1,2-trichloroethane, trichloroethylene, chloroform, monochlorobenzene, dichloroethlidene, methyl acetate, ethyl acetate, methylethyl ketone, and methyl isobutyl ketone, and these can be alone, or in combination. Particularly preferred are an aromatic solvent (e.g., toluene, and xylene), a halogenated hydrocarbon (e.g., methylene chloride, 1,2-dichloroethane, chloroform, and carbon tetrachloride) and ethyl acetate. An amount of the organic solvent for use is typically 0 parts by mass to 300 parts by mass, preferably 0 parts by mass to 100 parts by mass, and more preferably 25 parts by mass to 70 parts by mass, relative to 100 parts by mass of the toner materials.

(Aqueous Medium)

The aqueous medium may be water alone, or an aqueous medium containing an organic solvent, such as alcohol (e.g., methanol, isopropyl alcohol, and ethylene glycol), dimethyl formamide, tetrahydrofuran, Cellosolve (e.g., methyl cellosolve (registered trade mark)), and lower ketone (e.g., acetone, and methyl ethyl ketone).

An amount of the aqueous medium used relative to 100 parts by mass of the toner material liquid is typically 50 parts by mass to 2,000 parts by mass, preferably 100 parts by mass to 1,000 parts by mass. When the amount thereof is less than 50 parts by mass, the dispersed state of the toner material liquid is not desirable, and therefore toner particles having the intended particle diameters cannot be attained. When the amount thereof is greater than 2,000 parts by mass, it is not economically desirable.

(Surfactant and Resin Particles)

Moreover, a dispersant, such as a surfactant, and resin particles, is appropriately added to the aqueous medium, in order to improve dispersion of a colorant, a hybrid resin, and/or a releasing agent.

Examples o of the surfactant include: an anionic surfactant, such as alkyl benzene sulfonate, α-olefin sulfonic acid salt, and phosphonic acid ester; a cationic surfactant, such as an amine salt-based surfactant (e.g., alkyl amine salt, an amine alcohol fatty acid derivative, a polyamine fatty acid derivative, and imidazoline), and a quaternary ammonium salt-based surfactant (e.g., alkyl trimethyl ammonium salt, dialkyl dimethyl ammonium salt, alkyl dimethylbenzyl ammonium salt, pyridinium salt, alkyl isoquinolinium salt, and benzethonium chloride); a nonionic surfactant, such as a polyhydric alcohol derivative; and an amphoteric surfactant, such as alanine, dodecyl di(aminoethyl)glycine, di(octylaminoethynglycine, and N-alkyl-N,N-dimethyl ammonium betaine.

Moreover, use of a surfactant containing a fluoroalkyl group can improve the effect thereof with a small amount thereof. Examples of the anionic surfactant containing a fluoroalkyl group, which is preferably used, include C2-C10 fluoroalkyl carboxylic acid or a metal salt thereof, disodium perfluorooctane sulfonyl glutamate, sodium 3-[ω-fluoroalkyl (C6-C11)oxy)-1-alkyl(C3-C4)sulfonate, sodium 3-[ω-fluoroalkanoyl(C6-C8)-N-ethylamino]-1-propanesulfonate, fluoroalkyl(C11-C20) carboxylic acid or a metal salt thereof, perfluoroalkylcarboxylic acid(C7-C13) or a metal salt thereof, perfluoroalkyl(C4-C12)sulfonate or a metal salt thereof, perfluorooctanesulfonic acid diethanol amide, N-propyl-N-(2-hydroxyethyl)perfluorooctanesulfone amide, perfluoroalkyl(C6-C10)sulfone amide propyltrimethyl ammonium salt, a salt of perfluoroalkyl(C6-C10)-N-ethylsulfonylglycin and monoperfluoroalkyl(C6-C16)ethylphosphate.

Examples of a commercial product thereof include: SURFLON S-111, S-112, S-113 (all manufactured by Asahi Glass Co., Ltd.); FLUORAD FC-93, FC-95, FC-98, FC-129 (all manufactured by Sumitomo 3M Limited); UNIDYNE DS-101, DS-102 (all manufactured by DAIKIN INDUSTRIES, LTD.); MEGAFAC F-110, F-120, F-113, F-191, F-812, F-833 (all manufactured by DIC Corporation); EFTOP EF-102, 103, 104, 105, 112, 123A, 123B, 306A, 501, 201, 204 (all manufactured by Mitsubishi Materials Electronic Chemicals Co., Ltd.); and FUTARGENT F-100, F150 (all manufactured by NEOS COMPANY LIMITED).

Moreover, examples of the cationic surfactant include aliphatic primary, secondary, or tertiary perfluoroalkyl(C6-C10)sulfone amide containing a fluoroalkyl group, aliphatic quaternary ammonium salt (e.g., propyl trimethyl ammonium salt) benzalkonium salt, benzethonium chloride, pyridinium salt, and imidazolium salt. Examples of a commercial product thereof include SURFLON S-121 (manufactured by Asahi Glass Co., Ltd.), FLUORAD FC-135 (manufactured by Sumitomo 3M Limited), UNIDYNE DS-202 (manufactured by DAIKIN INDUSTRIES, LTD.), MEGAFAC F-150, F-824 (manufactured by DIC Corporation), EFTOP EF-132 (manufactured by Mitsubishi Materials Electronic Chemicals Co., Ltd.), and FUTARGENT F-300 (manufactured by NEOS COMPANY LIMITED).

(Resin Particles)

As for the resin particles, any resin can be used as long as it is a resin that can form an aqueous dispersion. The resin for the resin particles may be a thermoplastic resin or a thermoset resin. Examples of the resin include a vinyl resin, a polyurethane resin, an epoxy resin, a polyester resin, a polyamide resin, a polyimide resin, a silicon-based resin, a phenol resin, a melamine resin, a urea resin, an aniline resin, an iomer resin, and a polycarbonate resin. As for the resin, two or more resins selected from the above-listed resins may be used in combination.

Among them, preferred are a vinyl resin, a polyurethane resin, an epoxy resin, and a polyester resin, and a mixture thereof, as they can easily form an aqueous dispersion of spherical resin particles. For example, the vinyl resin is a homopolymer or copolymer of a vinyl monomer. Examples of the vinyl resin include resins, such as a styrene-(meth) acrylic acid ester copolymer, a styrene-butadiene copolymer, a (meth)acrylic acid-acrylic acid ester copolymer, a styrene-acrylonitrile copolymer, a styrene-maleic anhydride copolymer, a styrene-(meth)acrylic acid copolymer. The average particle diameter of the resin particles is 5 nm to 200 nm, preferably 20 nm to 300 nm. Moreover, an inorganic compound dispersing agent (e.g., tricalcium phosphate, calcium carbonate, titanium oxide, colloidal silica, and hydroxyapatite) can be also used.

(Dispersing Agent)

As for a dispersing agent usable in combination with the aforementioned resin particles, and inorganic compound dispersing agent, a polymeric protective colloid may be used to stabilize dispersed droplets. Examples thereof include: acid, such as acrylic acid, methacrylic acid, α-cyanoacrylic acid, α-cyanomethacryloc acid, itaconic acid, crotonic acid, fumaric acid, maleic acid, and maleic anhydride; a (meth) acryl-based monomer containing a hydroxyl group, such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin 1-acrylate, glycerin 1-methacrylate, N-methylol acrylamide, and N-methylol methacrylamide; vinyl alcohol or ether with vinyl alcohol, such as vinyl methyl ether, vinyl ethyl ether, and vinyl propyl ether; ester of vinyl alcohol and a compound containing a carboxyl group, such as vinyl acetate, vinyl propipnate, and vinyl acetate; a compound, such as acryl amide, methacryl amide, diacetone acryl amide, or a methylol compound thereof, acid chloride, such as acrylyl chloride, and methacrylyl chloride; a homopolymer or copolymer of a nitrogen-containing compound, or a compound containing a heterocycle thereof, such as vinylpyridine, vinyl pyrrolidone, vinyl imidazole, ethylene imine; a polyoxyethylene-based compound, such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester; and cellulose, such as methyl cellulose, hydroxyethyl cellulose, and hydroxypropyl cellulose.

(Method for Dispersing)

A method for dispersing is not particularly limited, but a conventional equipment known in the art, such as a low-speed shearing dispersing device, a high-speed shearing dispersing device, a friction dispersing device, a high-pressure jet device, and an ultrasonic wave dispersing device, can be used. Among them, a high-speed shearing dispersing device is preferable in order to attain dispersed elements diameters of which are 2 μm to 20 μm. In the case where the high-speed shearing dispersing device is used, the rotating speed thereof is not particularly limited, but it is typically 1,000 rpm to 30,000 rpm, preferably 5,000 rpm to 20,000 rpm. The duration for dispersing is not particularly limited, but in case of the batch system, it is typically 0.1 minutes to 5 minutes. The temperature during dispersing is typically 0° C. to 150° C. (under pressure), preferably 40° C. to 98° C.

(Removal of Organic Solvent, Washing, and Drying)

The organic solvent is removed from the emulsified dispersed elements (reaction product), the resultant is washed, and then dried to thereby obtain toner base particles.

In order to remove the organic solvent, the entire system is gradually heated in the stirring state of a laminar flow, and strong stirring force is applied in a certain temperature range, followed by removing the solvent, to thereby produce spindle-shaped toner base particles. In the case where a compound, which is dissolved in both acid and alkali, such as calcium phosphate, is used as a dispersion stabilizer, moreover, calcium phosphate is dissolved with acid, such as hydrochloric acid, followed by washing with water, to thereby remove calcium phosphate from the toner base particles. Other than the method as described, the dispersion stabilizer can be also removed by decomposition using an enzyme. To the obtained toner base particles, a charge controlling agent is placed, and inorganic particles, such as silica particles and titanium oxide particles, are deposited as external additives, to thereby obtain a toner. Note that, the placing of the charge controlling agent, and the externally adding the external additives are performed by a conventional method using a mixer or the like.

In view of uniformity of particle diameters, the value of the ratio [volume average particle diameter/number average particle diameter] of the toner of the present invention is preferably 1.0 to 1.4, more preferably 1.0 to 1.3. The volume average particle diameter of the toner is typically preferably 0.1 μm to 16 μm, although it varies depending on use of the toner. The upper limit thereof is more preferably 11 μm, particularly preferably 9 μm. The lower limit thereof is more preferably 0.5 μm, particularly preferably 1 μm. Note that, the volume average particle diameter and number average particle diameter of the toner can be measured at the same time by means of Multisizer III (manufactured by Beckman Coulter Inc.).

<Measurement of Particle Diameter>

The volume average particle diameter of color resin particles is measured in accordance with a coulter counter method. Examples of the measuring device include Coulter Counter TA-II, Coulter Multisizer II, and Coulter Multisizer III (all manufactured by Beckman Coulter Inc.). The measuring method is explained hereinafter.

First, 0.1 mL to 5 mL of a surfactant (preferably alkyl benzene sulfonate) is added as a dispersant to 100 mL to 150 mL of an electrolyte. Note that, the electrolyte is an about 1% by mass NaCl aqueous solution prepared by using grade-1 sodium chloride, and for example, ISOTON-II (of Beckman Coulter, Inc.) is used as the electrolyte. Next, to the resulting mixture, 2 mg to 20 mg of a sample is added. The electrolyte in which the sample has been suspended is dispersed by means of an ultrasonic wave disperser for about 1 minute to about 3 minutes. The volume and number of the toner particles or the toner are measured from the obtained dispersion liquid using the aforementioned measuring device with an aperture of 100 μm. The volume distribution and number distribution are then calculated. The volume average particle diameter and number average particle diameter of the toner can be determined based on the obtained distribution.

As for channels, the following 13 channels are used: 2.00 μm or larger, but smaller than 2.52 μm; 2.52 μm or larger, but smaller than 3.17 μm; 3.17 μm or larger, but smaller than 4.00 μm; 4.00 μm or larger, but smaller than 5.04 μm; 5.04 μm or larger, but smaller than 6.35 μm; 6.35 μm or larger, but smaller than 8.00 μm; 8.00 μm or larger, but smaller than 10.08 μm; 10.08 μm or larger, but smaller than 12.70 μm; 12.70 μm or larger, but smaller than 16.00 μm; 16.00 μm or larger, but smaller than 20.20 μm; 20.20 μm or larger, but smaller than 25.40 μm; 25.40 μm or larger, but smaller than 32.00 μm; and 32.00 μm or larger, but smaller than 40.30 μm. The target particles for the measurement are particles having the diameters of 2.00 μm or larger, but smaller than 40.30 μm.

[Emulsion Aggregation]

As for a method for producing a toner through emulsion aggregation, toner slurry is obtained aggregating and cohering at least binder resin dispersed elements with dispersed element of the colorant and dispersed elements of the wax, the aggregated elements are collected through washing and filtration in accordance with a conventional method, and the resultant is dried to thereby separate the toner base particles.

[Pulverization]

Examples of a method for producing a toner through pulverization include a method for producing a toner, which uses conventional members known in the art, and contains at least mechanically mixing a toner composition containing a binder resin, a charge controlling agent, and a colorant, melt-kneading the mixture, pulverizing the melt-kneaded product, and classifying the pulverized product. Note that, in the mechanically mixing, or the melt-kneading, the material, which is other than the toner as a final product, obtained during the pulverizing or the classifying can be recycled.

The mechanically mixing is not particularly limited, and can be carried out under the typical conditions using a mixer containing a stirring blade.

After completing the mixing, the mixture is loaded on a kneader, and is then melt-kneaded. As for the melt-kneader, a single or twin screw continuous kneader, or a batch-type kneader using a roll mill can be used. Specific examples thereof include KTK twin-screw extruder (manufactured by Kobe Steel, Ltd.)), TEM extruder (manufactured by Toshiba Machine Co., Ltd.), a twin-screw extruder (manufactured by KCK K.K.), PCM twin-screw extruder (manufactured by Ikegai, Ltd.), and Buss Cokneader (manufactured by Buss A.G.). The melt-kneading is ideally performed under the conditions with which molecular chains of the binder resin are not cut. When the melt-kneading temperature is excessively low relative to a softening point of the binder resin, scission of molecular chains is caused. When the melt-kneading temperature is excessively high, dispersion of the charge controlling agent, the colorant, etc., is not progressed. Therefore, the melt-kneading temperature is preferably appropriately set depending on the softening point of the resin.

Once the melt-kneading is completed, the kneaded product is pulverized. In the process of the pulverizing, it is preferred that the kneaded product be roughly pulverized, followed by finely pulverizing the resultant. Examples of such a pulverization method include: a method, in which the kneaded product is crashed against an impact plate in jet flows to pulverize; and a method, in which the kneaded product is pulverized in a narrow gap between a rotor that is mechanically rotating and a stator.

After completing the pulverizing, the pulverized product is classified in air flow by centrifugal force etc., to thereby obtain a toner having a certain particle diameter.

[Other Components]

Other components are appropriately selected depending on the intended purpose without any limitation, and examples thereof include a colorant, a releasing agent, a charge controlling agent, external additives, and a flow improving agent, a cleaning improving agent, and a magnetic material.

[Colorant]

The colorant is appropriately selected depending on the intended purpose without any limitation, and examples thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G, R), tartrazinelake, quinoline yellow lake, anthrasan yellow BGL, isoindolinon yellow, colcothar, red lead, lead vermilion, cadmium red, cadmium mercury red, antimony vermilion, permanent red 4R, parared, fiser red, parachloroorthonitro aniline red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red F5R, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone.

An amount of the colorant is appropriately selected depending on the intended purpose without any limitation, but the amount thereof is preferably 1 part by mass to 15 parts by mass, more preferably 3 parts by mass to 10 parts by mass, relative to 100 parts by mass of the toner.

The colorant may be used as a master batch, in which the colorant forms a composite with a resin. Examples of the resin for use in the production of the master batch, or kneaded together with the master batch include, other than the aforementioned non-crystalline polyester resin, a polymer of styrene or a derivative thereof (e.g., polystyrene, poly(p-chlorostyrene), and polyvinyl toluene), a styrene-based copolymer (e.g., a styrene-p-chlorostyrene copolymer, a styrene-propylene copolymer, a styrene-vinyl toluene copolymer, a styrene-vinyl naphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl $\alpha$-chloromethacrylate copolymer, a styrene-acrylonitrile copolymer, a styrene-vinyl methyl ketone copolymer, a styrene-butadiene copolymer, a styrene-isoprene copolymer, a styrene-acrylonitrile-indene copolymer, a styrene-maleic acid copolymer, and a styrene-maleic acid ester copolymer), polymethyl methacrylate, polybutyl methacrylate, polyvinyl chloride, polyvinyl acetate, polyethylene, polypropylene, an epoxy resin, epoxy polyol resin, polyurethane, polyamide, polyvinyl butyral, polyacrylic acid resin, rosin, modified rosin, a terpene resin, an aliphatic hydrocarbon resin, an alicyclic hydrocarbon resin, aromatic petroleum resin, chlorinated paraffin, and paraffin wax. These may be used alone, or in combination.

The master batch can be produced by mixing or kneading the resin and the colorant together through application of high shearing force. An organic solvent may be used in the production of the master batch for improving the interactions between the colorant and the resin. Moreover, a so-called flashing method is preferably used, since a wet cake of the colorant can be directly used without being dried. The flashing method is a method in which an aqueous paste containing a colorant is mixed or kneaded with a resin and an organic solvent, and then the colorant is transferred to the resin to remove the moisture and the organic solvent. In the mixing or kneading, a high-shearing disperser (e.g., a three-roll mill) is preferably used.

[Releasing Agent]

The releasing agent is appropriately selected from those known in the art without any limitation.

Examples of the releasing agent of wax include natural wax, such as vegetable wax (e.g. carnauba wax, cotton wax, Japan wax, and rice wax), animal wax (e.g., bees wax and lanolin), mineral wax (e.g., ozokelite and ceresin), and petroleum wax (e.g., paraffin wax, microcrystalline wax and petrolatum).

Examples of the wax other than the natural wax listed above include synthetic hydrocarbon wax (e.g., Fischer-Tropsch wax, polyethylene wax and polypropylene wax), and synthetic wax (e.g., ester wax, ketone wax and ether wax).

As for the releasing agent, moreover, usable are fatty acid amide (1,2-hydroxystearic acid amide, stearic amide, and phthalic anhydride imide); and low-molecular-weight crystalline polymer resin such as acrylic homopolymer (e.g., poly-n-stearyl methacrylate and poly-n-lauryl methacrylate)

and acrylic copolymer (e.g., n-stearyl acrylate-ethyl methacrylate copolymer); and crystalline polymer having a long alkyl group as a side chain.

Among them, preferred is paraffin, microcrystalline wax, a hydrocarbon wax, such as Fischer-Tropsch wax, polyethylene wax and polypropylene wax.

A melting point of the releasing agent is appropriately selected depending on the intended purpose without any limitation, but the melting point thereof is preferably 60° C. or higher but lower than 95° C.

The releasing agent is more preferably hydrocarbon was having a melting point of 60° C. or higher but lower than 95° C. This releasing agent can effectively functions as a releasing agent between a fixing roller and an interface of the toner, and therefore hot offset resistance can be improved without applying a releasing agent, such as oil, to the fixing roller.

Especially, the hydrocarbon wax is preferable because the hydrocarbon wax has hardly any compatibility to the crystalline polyester resin, and can function separately from the crystalline polyester resin, and therefore it does not impair a softening effect of the crystalline to polyester resin as a binder resin, and offset properties of the releasing agent.

When the melting point of the releasing agent is lower than 60° C., the releasing agent tends to melt at low temperature and therefore a resulting toner may have poor heat resistant storage stability. When the melting point of the releasing agent is 95° C. or higher, the releasing agent may not be melted sufficiently by heating during fixing, and therefore sufficient offset properties may not be attained.

An amount of the releasing agent is appropriately selected depending on the intended purpose without any limitation, but the amount thereof is preferably 2 parts by mass to 10 parts by mass, more preferably 3 parts by mass to 8 parts by mass, relative to 100 parts by mass of the toner. When the amount thereof is smaller than 2 parts by mass, hot offset resistance and low temperature fixing ability during fixing may be impaired. When the amount thereof is greater than 10 parts by mass, heat resistant storage stability may be impaired, and fogging of an image may be caused. When the amount thereof is within the aforementioned more preferable range, it is advantageous as image quality and fixing stability can be improved.

[Charge Controlling Agent]

The charge controlling agent is appropriately selected depending on the intended purpose without any limitation, and examples thereof include a nigrosine dye, a triphenyl methane-based dye, a chrome-containing metal complex dye, a molybdic acid chelate pigment, a rhodamine dye, alkoxy amine, quaternary ammonium salt (including fluorine-modified quaternary ammonium salt), alkyl amide, phosphorus or a phosphorus compound, tungsten or a tungsten compound, a fluorine-based active agent, a metal salt of salicylic acid, and a metal salt of a salicylic acid derivative. Specific examples thereof include nigrosine dye BONTRON 03, quaternary ammonium salt BONTRON P-51, metal-containing azo dye BONTRON S-34, oxynaphthoic acid-based metal complex E-82, salicylic acid-based metal complex E-84 and phenol condensate E-89 (all manufactured by ORIENT CHEMICAL INDUSTRIES CO., LTD); quaternary ammonium salt molybdenum complex TP-302 and TP-415 (all manufactured by Hodogaya Chemical Co., Ltd.); LRA-901, and boron complex LR-147 (manufactured by Japan Carlit Co., Ltd.); copper phthalocyanine; perylene; quinacridone; azo pigments; and polymeric compounds having, as a functional group, a sulfonic acid group, carboxyl group, and quaternary ammonium salt.

An amount of the charge controlling agent is appropriately selected depending on the intended purpose without any limitation, but the amount thereof is preferably 0.1 parts by mass to 10 parts by mass, more preferably 0.2 parts by mass to 5 parts by mass, relative to 100 parts by mass of the toner. When the amount thereof is greater than 10 parts by mass, charging ability of the toner becomes excessively large, a main effect of the charge controlling agent is reduced, and therefore electrostatic force with the developing roller increases to reduce flowability of the developer, or reduce image density. Any of the aforementioned charge controlling agents may be melt-kneaded together with the master batch and the resin, followed by dispersing, or may be added directly to the organic solvent when dispersed, or may be deposited on surfaces of the toner after the production of the toner particles.

[External Additives]

As for the external additives, other than oxide particles, inorganic particles or hydrophobic inorganic particles can be used in combination. The average particle diameter of primary particles of hydrophobic inorganic particles is preferably 1 nm to 100 nm, more preferably 5 nm to 70 nm.

Moreover, it is preferred that the external additives contain at least one type of the hydrophobic inorganic particles the average particle diameter of primary particles of which is 20 nm or smaller, and at least on type of inorganic particles the average particle diameter of primary particles of which is 30 nm or greater.

Moreover, the BET specific surface area of the external additives is preferably 20 $m^2/g$ to 500 $m^2/g$.

The external additives are appropriately selected depending on the intended purpose without any limitation, and examples thereof include silica particles, hydrophobic silica, fatty acid metal salt (e.g., zinc stearate, aluminum stearate), metal oxide (e.g., titania, alumina, tin oxide, and antimony oxide), and fluoropolymer.

As for suitable additives, there are hydrophobic silica, titania, titanium oxide, and alumina particles. Examples of the silica particles include R972, R974, RX200, RY200, R202, R805, and R812 (all manufactured by Nippon Aerosil Co., Ltd.). Examples of the titania particles include: P-25 (manufactured by Nippon Aerosil Co., Ltd.); STT-30, STT-65C-S (both manufactured by Titan Kogyo, Ltd.); TAF-140 (manufactured by Fuji Titanium Industry Co., Ltd.); and MT-150W, MT-500B, MT-600B, MT-150A (all manufactured by TAYCA CORPORATION).

Examples of the hydrophobic titanium oxide particles include: T-805 (manufactured by Nippon Aerosil Co., Ltd.); STT-30A, STT-65S-S (both manufactured by Titan Kogyo, Ltd.); TAF-500T, TAF-1500T (both manufactured by Fuji Titanium Industry Co., Ltd.); MT-100S, MT-100T (both manufactured by TAYCA CORPORATION); and IT-S (manufactured by ISHIHARA SANGYO KAISHA, LTD.).

In order to attain hydrophobing-treated oxide particles, hydrophobing-treated silica particles, hydrophobing-treated titania particles, or hydrophobing-treated alumina particles, hydrophilic particles can be treated with a silane coupling agent, such as methyltrimethoxy silane, methyltriethoxy silane, and octyltrimethoxy silane. Moreover, preferred are silicone oil-treated oxide particles or inorganic particles, obtained by treating inorganic particles with silicone oil optionally upon application of heat.

Examples of the silicone oil include dimethyl silicone oil, methylphenyl silicone oil, chlorophenyl silicone oil, methyl hydrogen silicone oil, alkyl-modified silicone oil, fluorine-modified silicone oil, poly ether-modified silicone oil, alcohol-modified silicone oil, amino-modified silicone oil, epoxy-modified silicone oil, epoxy/polyether-modified silicone oil, phenol-modified silicone oil, carboxyl-modified silicone oil, mercapto-modified silicone oil, acryl or methacryl-modified silicone oil, and α-methyl styrene-modified silicone oil. Examples of the inorganic particles include silica, alumina, titanium oxide, barium titanate, magnesium titanate, calcium titanate, strontium titanate, iron oxide, copper oxide, zinc oxide, tin oxide, quartz sand, clay, mica, wollastonite, diatomaceous earth, chromic oxide, cerium oxide, red iron oxide, antimony trioxide, magnesium oxide, zirconium oxide, barium sulfate, barium carbonate, calcium carbonate, silicon carbide, and silicon nitride. Among them, silica and titanium oxide are particularly preferable.

An amount of the external additives is appropriately selected depending on the intended purpose without any limitation, but the amount thereof is preferably 0.1% by mass to 5% by mass, more preferably 0.3% by mass to 3% by mass, relative to the toner.

The average particle diameter of primary particles of the inorganic particles is appropriately selected depending on the intended purpose without any limitation, but it is preferably 100 nm or smaller, more preferably 3 nm to 70 nm. When the average particle diameter thereof is smaller than the aforementioned range, the inorganic particles are embedded in the toner, and therefore a function thereof is not effectively exhibited. When the average particle diameter thereof is greater than the aforementioned range, it is not preferable because the inorganic particles may unevenly damage a surface of a photoconductor.

[Flow Improving Agent]

The flow improving agent is appropriately selected depending on the intended purpose without any limitation, provided that it increases hydrophobicity through a surface treatment, and can prevent reduction in flowability and charging properties under high humidity conditions. Examples of the flow improving agent include a silane coupling agent, a sililation agent, a silane coupling agent containing a fluoroalkyl group, an organic titanate-based coupling agent, an aluminum-based coupling agent, silicone oil, and modified-silicone oil. It is particularly preferred that the silica or titanium oxide be subjected to a surface treatment with the flow improving agent, and the resultant be used as hydrophobic silica or hydrophobic titanium oxide.

[Cleaning Improving Agent]

The cleaning improving agent is appropriately selected depending on the intended purpose without any limitation, provided that it is added to the toner for the purpose of removing the developing agent remained on a photoconductor or a primary transferring member after transferring. Examples thereof include: fatty acid (e.g. stearic acid) metal salt, such as zinc stearate, and calcium stearate; and polymer particles produced through soap-free emulsion polymerization, such as polymethyl methacrylate particles, and polystyrene particles. As for the polymer particles, those having a relatively narrow particle size distribution are preferable. The polymer particles preferably have the volume average particle diameter of 0.01 μm to 1 μm.

[Magnetic Material]

The magnetic material is appropriately selected depending on the intended purpose without any limitation, and examples thereof include iron powder, magnetite, and ferrite. Among them, a white magnetic material is preferably in view of color tone.

EXAMPLES

The present invention is more specifically explained through Examples hereinafter, but Examples are used as an aid to understand the present invention, and does not limit the scope of the present invention. In Examples, "part(s)" and "%" denote respectively "part(s) by mass" and "% by mass" unless otherwise stated.

[Synthesis of Non-Crystalline Polyester Resin 1]

A reaction vessel equipped with a cooling tube stirrer, and a nitrogen inlet tube was charged with 180 parts of propylene glycol, 270 parts of terephthalic acid, 30 parts of adipic acid, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg, Then, 5 parts of trimellitic anhydride was added to the reaction vessel, and the mixture was allowed to react for 1 hour at 180° C. under atmospheric pressure, to thereby synthesize Non-Crystalline Polyester Resin 1.

A diffraction spectrum of Non-Crystalline Polyester Resin 1 as obtained by an X-ray diffraction spectrometer did not have a diffraction peak derived from a crystal structure, and Non-Crystalline Polyester Resin 1 had the number average molecular weight of 4,400, the weight average molecular weight of 9,500, and the glass transition temperature of 61° C.

[Synthesis of Non-Crystalline Polyester Resin 2]

A reaction vessel equipped with a cooling tube stirrer, and a nitrogen inlet tube was charged with 40 parts (a proportion in the polyol is 5.0 mol %) of bisphenol A propylene oxide (2 mol) adduct, 168 parts of propylene glycol, 273 parts of terephthalic acid, 27 parts of adipic acid, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg. Then, 5 parts of trimellitic anhydride was added to the reaction vessel, and the mixture was allowed to react for 1 hour at 180° C. under atmospheric pressure, to thereby synthesize Non-Crystalline Polyester Resin 2.

A diffraction spectrum of Non-Crystalline Polyester Resin 2 as obtained by an X-ray diffraction spectrometer did not have a diffraction peak derived from a crystal structure, and Non-Crystalline Polyester Resin 2 had the number average molecular weight of 4,600, the weight average molecular weight of 10,300, and the glass transition temperature of 62° C.

[Synthesis of Non-Crystalline Polyester Resin 3]

A reaction vessel equipped with a cooling tube stirrer, and a nitrogen inlet tube was charged with 78 parts (a proportion in polyol is 9.5 mol %) of bisphenol A propylene oxide (2 mol) adduct, 164 parts of propylene glycol, 282 parts of terephthalic acid, 18 parts of adipic acid, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg. Then, 5 parts of trimellitic anhydride was added to the reaction vessel, and the mixture was allowed to react for 1 hour at 180° C. under atmospheric pressure, to thereby synthesize Non-Crystalline Polyester Resin 3.

A diffraction spectrum of Non-Crystalline Polyester Resin 3 as obtained by an X-ray diffraction spectrometer did not have a diffraction peak derived from a crystal structure, and Non-Crystalline Polyester Resin 3 had the number average molecular weight of 4,500, the weight average molecular weight of 9,900, and the glass transition temperature of 64° C.

[Synthesis of Non-Crystalline Polyester Resin 4]

A reaction vessel equipped with a cooling tube stirrer, and a nitrogen inlet tube was charged with 352 parts (a proportion in polyol is 65 mol %) of bisphenol A propylene oxide (2 mol)

adduct, 42 parts of propylene glycol, 17 parts of adipic acid, 236 parts of dimethyl isophthalate, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg. Then, 5 parts of trimellitic anhydride was added to the reaction vessel, and the mixture was allowed to react for 1 hour at 180° C. under atmospheric pressure, to thereby synthesize Non-Crystalline Polyester Resin 4.

A diffraction spectrum of Non-Crystalline Polyester Resin 4 as obtained by an X-ray diffraction spectrometer did not have a diffraction peak derived from a crystal structure, and Non-Crystalline Polyester Resin 4 had the number average molecular weight of 4,800, the weight average molecular weight of 11,000, and the glass transition temperature of 63° C.

[Synthesis of Crystalline Polyester Resin 1]

A reaction vessel equipped with a cooling tube stirrer, and a nitrogen inlet tube was charged with 249 parts of 1,6-hexanediol, 394 parts of sebacic acid, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg, to thereby synthesize Crystalline Polyester Unit 1.

Crystalline Polyester Unit 1 had the number average molecular weight of 4,000, the weight average molecular weight of 9,100, the nitrogen atom concentration of 1.7% by mass, and the melting point of 66° C. Moreover, a ratio (softening temperature/maximum peak temperature of heat of melting) of the softening temperature of Crystalline Polyester Unit 1 as measured by a capillary rheometer to the maximum peak temperature of the heat of melting of Crystalline Polyester Unit 1 as measured by a differential scanning calorimeter (DSC) was 1.12.

A reaction vessel equipped with a cooling tube stirrer, and a nitrogen inlet tube was charged with 235 parts of bisphenol A propylene oxide (2 mol) adduct, 10 parts of propylene glycol, 254 parts of 4,4'-diphenylmethanediisocyanate, and 600 parts of ethyl acetate, and the resulting mixture was allowed to react for 3 hours at 80° C. under atmospheric pressure, to thereby synthesize Polyurethane Prepolymer 1.

Polyurethane Prepolymer 1 had the number average molecular weight of 2,600.

A reaction vessel equipped with a cooling tube stirrer, and a nitrogen inlet tube was charged with 429 parts of Crystalline Polyester Unit 1, 176 parts of Polyurethane Prepolymer 1, and 400 parts of ethyl acetate, and the resulting mixture was allowed to react for 5 hours at 80° C. under atmospheric pressure, followed by removing the solvent, to thereby obtain Crystalline Polyester Resin 1 composed of the crystalline polyester unit and the polyurethane prepolymer unit.

A diffraction spectrum of Crystalline Polyester Resin 1 as obtained by an X-ray diffraction spectrometer had a diffraction peak derived from a crystal structure, and Crystalline Polyester Resin 1 had the number average molecular weight of 10,100, the weight average molecular weight of 31,100, the nitrogen atom concentration of 1.7% by mass, and the melting point of 57° C. Moreover, a ratio (softening temperature/maximum peak temperature of heat of melting) of the softening temperature of Crystalline Polyester Resin 1 as measured by a capillary rheometer to the maximum peak temperature of the heat of melting of Crystalline Polyester Resin 1 as measured by a differential scanning calorimeter (DSC) was 1.12.

[Synthesis of Crystalline Polyester Resin 2]

A reaction vessel equipped with a cooling tube stirrer, and a nitrogen inlet tube was charged with 369 parts of 1,10-decanediol, 289 parts of adipic acid, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg, to thereby synthesize Crystalline Polyester Unit 2. Crystalline Polyester Unit 2 had the number average molecular weight of 4,900, the weight average molecular weight of 10,200, and the melting point of 65° C.

A reaction vessel equipped with a cooling tube stirrer, and a nitrogen inlet tube was charged with 427 parts of Crystalline Polyester Unit 2, 15 parts of 4,4'-diphenylmethane diisocyanate, and 420 parts of ethyl acetate, and the resulting mixture was allowed to react for 5 hours at 80° C. under atmospheric pressure, followed by removing the solvent, to thereby obtain Crystalline Polyester Resin 2 composed of the crystalline polyester unit and the polyurethane prepolymer unit.

A diffraction spectrum of Crystalline Polyester Resin 2 as obtained by an X-ray diffraction spectrometer had a diffraction peak derived from a crystal structure, and Crystalline Polyester Resin 2 had the number average molecular weight of 11,300, the weight average molecular weight of 33,100, the nitrogen atom concentration of 0.4% by mass, and the melting point of 62° C. Moreover, a ratio (softening temperature/maximum peak temperature of heat of melting) of the softening temperature of Crystalline Polyester Resin 2 as measured by a capillary rheometer to the maximum peak temperature of the heat of melting of Crystalline Polyester Resin 2 as measured by a differential scanning calorimeter (DSC) was 1.05.

[Synthesis of Crystalline Polyester Resin 3]

A reaction vessel equipped with a cooling tube stirrer, and a nitrogen inlet tube was charged with 252 parts of 1,6-hexanediol, 390 parts of sebacic acid, and 0.8 parts of dibutyl tin oxide, and the resulting mixture was allowed to react for 6 hours at 180° C. under atmospheric pressure. Next, the resultant was allowed to react for 3 hours under the reduced pressure of 10 mmHg to 15 mmHg, to thereby synthesize Crystalline Polyester Unit 3.

Crystalline Polyester Unit 3 had the number average molecular weight of 3,300, the weight average molecular weight of 7,800, and the melting point of 65° C.

A reaction vessel equipped with a cooling tube stirrer, and a nitrogen inlet tube was charged with 358 parts of Crystalline Polyester Unit 3, 251 parts of Polyurethane Prepolymer 1, and 400 parts of ethyl acetate, and the resulting mixture was allowed to react for 5 hours at 80° C. under atmospheric pressure, followed by removing the solvent, to thereby obtain Crystalline Polyester Resin 3 composed of the crystalline polyester unit and the polyurethane prepolymer unit.

A diffraction spectrum of Crystalline Polyester Resin 3 as obtained by an X-ray diffraction spectrometer had a diffraction peak derived from a crystal structure, and Crystalline Polyester Resin 3 had the number average molecular weight of 9,900, the weight average molecular weight of 31,400, the nitrogen atom concentration of 2.5% by mass, and the melting point of 56° C. Moreover, a ratio (softening temperature/maximum peak temperature of heat of melting) of the softening temperature of Crystalline Polyester Resin 3 as measured by a capillary rheometer to the maximum peak temperature of the heat of melting of Crystalline Polyester Resin 3 as measured by a differential scanning calorimeter (DSC) was 1.24.

[Synthesis of Crystalline Polyester Resin 4]

A reaction vessel equipped with a cooling tube stirrer, and a nitrogen inlet tube was charged with 229 parts of 1,3-butanediol, 393 parts of adipic acid, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg, to thereby synthesize Crystalline Polyester Unit 4.

Crystalline Polyester Unit 4 had the number average molecular weight of 3,900, the weight average molecular weight of 9,000, and the melting point of 45° C.

A reaction vessel equipped with a cooling tube stirrer, and a nitrogen inlet tube was charged with 428 parts of Crystalline Polyester Unit 4, 177 parts of Polyurethane Prepolymer 1, and 400 parts of ethyl acetate, and the resulting mixture was allowed to react for 5 hours at 80° C. under atmospheric pressure, followed by removing the solvent, to thereby obtain Crystalline Polyester Resin 4 composed of the crystalline polyester unit and the polyurethane prepolymer unit.

A diffraction spectrum of Crystalline Polyester Resin 4 as obtained by an X-ray diffraction spectrometer had a diffraction peak derived from a crystal structure, and Crystalline Polyester Resin 4 had the number average molecular weight of 11,000, the weight average molecular weight of 32,100, the nitrogen atom concentration of 1.7% by mass, and the melting point of 44° C. Moreover, a ratio (softening temperature/maximum peak temperature of heat of melting) of the softening temperature of Crystalline Polyester Resin 4 as measured by a capillary rheometer to the maximum peak temperature of the heat of melting of Crystalline Polyester Resin 4 as measured by a differential scanning calorimeter (DSC) was 1.10.

[Synthesis of Crystalline Polyester Resin 5]

A reaction vessel equipped with a cooling tube stirrer, and a nitrogen inlet tube was charged with 261 parts of 1,10-decanediol, 277 parts of sebacic acid, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg, to thereby synthesize Crystalline Polyester Unit 5.

Crystalline Polyester Unit 5 had the number average molecular weight of 4,200, the weight average molecular weight of 10,500, and the melting point of 72° C.

A reaction vessel equipped with a cooling tube stirrer, and a nitrogen inlet tube was charged with 432 parts of Crystalline Polyester Unit 5, 176 parts of Polyurethane Prepolymer 1, and 400 parts of ethyl acetate, and the resulting mixture was allowed to react for 5 hours at 80° C. under atmospheric pressure, followed by removing the solvent, to thereby obtain Crystalline Polyester Resin 5 composed of the crystalline polyester unit and the polyurethane prepolymer unit.

A diffraction spectrum of Crystalline Polyester Resin 5 as obtained by an X-ray diffraction spectrometer had a diffraction peak derived from a crystal structure, and Crystalline Polyester Resin 5 had the number average molecular weight of 9,800, the weight average molecular weight of 29,900, the nitrogen atom concentration of 1.7% by mass, and the melting point of 69° C. Moreover, a ratio (softening temperature/maximum peak temperature of heat of melting) of the softening temperature of Crystalline Polyester Resin 5 as measured by a capillary rheometer to the maximum peak temperature of the heat of melting of Crystalline Polyester Resin 5 as measured by a differential scanning calorimeter (DSC) was 1.13.

[Synthesis of Crystalline Polyester Resin 6]

A reaction vessel equipped with a cooling tube stirrer, and a nitrogen inlet tube was charged with 245 parts of 1,6-hexanediol, 406 parts of sebacic acid, and 0.8 parts of dibutyl tin oxide, and the resulting mixture was allowed to react for 6 hours at 180° C. under atmospheric pressure. Next, the resultant was allowed to react for 4 hours under the reduced pressure of 10 mmHg to 15 mmHg, to thereby synthesize Crystalline Polyester Resin 6.

A diffraction spectrum of Crystalline Polyester Resin 6 as obtained by an X-ray diffraction spectrometer had a diffraction peak derived from a crystal structure, and Crystalline Polyester Resin 6 had the number average molecular weight of 9,700, the weight average molecular weight of 23,700, the nitrogen atom concentration of 0.1% by mass, and the melting point of 67° C. Moreover, a ratio (softening temperature/maximum peak temperature of heat of melting) of the softening temperature of Crystalline Polyester Resin 6 as measured by a capillary rheometer to the maximum peak temperature of the heat of melting of Crystalline Polyester Resin 6 as measured by a differential scanning calorimeter (DSC) was 1.01.

[Production of Crystalline Polyester Resin Dispersion Liquid 1]

A reaction vessel equipped with a cooling tube, thermometer, and a stirrer was charged with 20 parts by mass of Crystalline Polyester Resin 1, and 80 parts by mass of ethyl acetate, and the mixture was heated to 78° C. to sufficiently dissolve Crystalline Polyester Resin 1, followed by cooling to 30° C. over 1 hour with stirring. Thereafter, the resultant was subjected to wet pulverization by means of ULTRA VISCOMILL (manufactured by AIMEX Co., Ltd.) under the conditions where a liquid feeding rate was 1.0 Kg/hr, a disc circumferential velocity was 10 m/sec, an amount of 0.5 mm-zorconia beads packed was 80% by volume, and a number of passes was 6. Finally, ethyl acetate was added to adjust the solid content thereof to 20%, to thereby obtain Crystalline Polyester Resin Dispersion Liquid 1.

[Production of Colorant Dispersion Liquid]

A beaker was charged with 20 parts of copper phthalocyanine, 4 parts of a colorant dispersing agent (SOLSPERSE 28000, manufactured by Lubrizol Corporation), and 76 parts of ethyl acetate, and the resulting mixture was homogeneously dispersed by stirring. Thereafter, the copper phthalocyanine in the resultant was finely dispersed by a bead mill, to thereby obtain Colorant Dispersion Liquid 1. The volume average particle diameter of Colorant Dispersion Liquid 1 as measured by a particle size analyzer LA-920 (manufactured by HORIBA, Ltd.) was 0.3 μm.

[Production of Releasing Agent Dispersion Liquid 1]

A reaction vessel equipped with a cooling tube, thermometer, and a stirrer was charged with 15 parts by mass of sunflower wax (manufactured by NIPPON SEIRO CO., LTD.), and 85 parts by mass of ethyl acetate, and the mixture was heated to 78° C. to sufficiently dissolve the wax, followed by cooling to 30° C. over 1 hour with stirring. Thereafter, the resultant was subjected to wet pulverization by means of ULTRA VISCOMILL (manufactured by AIMEX Co., Ltd.) under the conditions where a liquid feeding rate was 1.0 Kg/hr, a disc circumferential velocity was 10 m/sec, an amount of 0.5 mm-zorconia beads packed was 80% by volume, and a number of passes was 6. Finally, ethyl acetate was added to adjust the solid content thereof to 15%, to thereby obtain Releasing Agent Dispersion Liquid 1.

[Production of Releasing Agent Dispersion Liquid 2]

A reaction vessel equipped with a cooling tube, thermometer, and a stirrer was charged with 15 parts by mass of ester wax (a mixture of behenyl behenate and behenyl stearate), and 85 parts by mass of ethyl acetate, and the mixture was heated to 78° C. to sufficiently dissolve the wax, followed by cooling to 30° C. over 1 hour with stirring. Thereafter, the resultant was subjected to wet pulverization by means of ULTRA VISCOMILL (manufactured by AIMEX Co., Ltd.) under the conditions where a liquid feeding rate was 1.0 Kg/hr, a disc circumferential velocity was 10 m/sec, an amount of 0.5 mm-zorconia beads packed was 80% by volume, and a number of passes was 6. Finally, ethyl acetate was added to adjust the solid content thereof to 15%, to thereby obtain Releasing Agent Dispersion Liquid 2.

(Measuring Method of Ethyl Acetate Soluble Component of Releasing Agent)

A 30 mL sample tube was charged with 2.4 g of wax, and 21.6 g of ethyl acetate. The sample tube was left to stand for 1 hour in a water bath of 50° C. with a lid on. Thereafter, the sample mixture was sufficiently stirred in the water bath, followed by leaving to stand for 2 hours at 50° C. The supernatant liquid thereof (8 g to 12 g) was taken out and weighted (Ws), and an amount of the residue obtained by removing a volatile component from the supernatant liquid for 30 minutes at 150° C. was weighted (Wr). A mass ratio (Wr/Ws) of the supernatant liquid to the residue was determined as an ethyl acetate soluble component. Note that, in the case where solubility of the releasing agent to the ethyl acetate of 50° C. was extremely high, in the present test, the entire releasing agent was dissolved in the ethyl acetate to form a homogeneous phase. In this case, the ethyl acetate soluble component was determined as 10% by weight or greater.

Example 1

A beaker was charged with 25 parts of Crystalline Polyester Resin 1, 75 parts of Non-Crystalline Polyester Resin 1, 14 parts of Releasing Agent Dispersion Liquid 1, 10 parts of Colorant Dispersion Liquid 1, and 84 parts of ethyl acetate, and the mixture was heated to 50° C. to dissolve the resin with stirring. Thereafter, the resultant was stirred by means of TK Homomixer at 8,000 rpm to homogeneously disperse, to thereby obtain Toner Material Liquid 1.

A beaker was charged with 99 parts of ion-exchanged water, 6 parts of 25% by weight aqueous dispersion liquid of organic particles (a copolymer of styrene/methacrylic acid/butyl acrylate/a sodium salt of sulfuric acid ester of methacrylic acid-ethylene oxide adduct) for stabilizing dispersion, 1 part of sodium carboxymethyl cellulose, and 10 parts of a 48.5% aqueous solution of sodium dodecyldiphenyl ether disulfonate (ELEMINOL MON-7, manufactured by Sanyo Chemical Industries Ltd.), and the mixture was homogeneously dissolved.

To the resultant, 75 parts of Toner Material Liquid 1 was added with stirring by means of TK Homomixer at 10,000 rpm at 50° C., and the resulting mixture was stirred for 2 minutes.

Subsequently, the resulting mixed liquid was transferred to a flask equipped with a stirring rod and a thermometer, and the ethyl acetate therein was removed at 55° C. until the concentration thereof was to be 0.5% or lower. Thereafter, the resultant was cooled to 20° C. at the cooling rate of 20° C./min, to thereby Aqueous Resin Dispersion of Resin Particles 1.

As for the washing step, subsequently, Aqueous Resin Dispersion of Resin Particles 1 was filtered, and 300 parts by mass of ion-exchanged water was added to the obtained filtration cake. The resultant was mixed by means of TK Homomixer for 10 minutes at 12,000 rpm, followed by filtering the resulting mixture. This course of processes was performed twice.

Next, 300 parts by mass of ion-exchanged water was added to the obtained filtration cake, and the resulting mixture was mixed by means of TK Homomixer for 10 minutes at 12,000 rpm, followed by filtering the mixture. This course of processes was performed three times. To the obtained filtration cake, 300 parts by mass of 1% by mass hydrochloric acid was added, and the resulting mixture was mixed by means of TK Homomixer for 10 minutes at 12,000 rpm, followed by filtering the mixture. Finally, to the obtained filtration cake, 300 parts by mass of ion-exchanged water is added, and the resulting mixture was mixed by means of TK Homomixer for 10 minutes at 12,000 rpm, followed by filtering the mixture. This course of processes was performed twice, to thereby obtain a filtration cake.

After pulverizing the obtained cake, the resultant was dried for 22 hours at 40° C., to thereby obtain Resin Particles 1 having the volume average particle diameter of 5.5 μm.

By means of HENSCHEL MIXER (manufactured by Nippon Cole & Engineering Co., Ltd.), 100 parts by mass of Resin Particles 1 were mixed with 1.0 part by mass of hydrophobic silica (H2000, manufactured by Clariant Japan K.K.) serving as external additives for 30 seconds at the rim speed of 30 m/sec., followed by rested for 1 minute. This cycle of the mixing process was performed 5 times, followed by sieving the resultant with a mesh having an opening size of 35 μm, to thereby produce Toner 1.

Example 2

A beaker was charged with 9 parts of Crystalline Polyester Resin 1, 91 parts of Non-Crystalline Polyester Resin 1, 14 parts of Releasing Agent Dispersion Liquid 1, 10 parts of Colorant Dispersion Liquid 1, and 84 parts of ethyl acetate, and the resins were dissolved at 50° C. with stirring. Then, the resultant was stirred by means of TK Homomixer at 8,000 rpm to homogeneously disperse, to thereby obtain Toner Material Liquid 2. Thereafter, Toner 2 was obtained in the same manner as in Example 1, provided that Toner Material Liquid 1 was replaced with Toner Material Liquid 2.

Example 3

A beaker was charged with 49 parts of Crystalline Polyester Resin 1, 51 parts of [Non-Crystalline Polyester Resin 1, 14 parts of Releasing Agent Dispersion Liquid 1, 10 parts of Colorant Dispersion Liquid 1, and 84 parts of ethyl acetate, and the resins were dissolved at 50° C. with stirring. Then, the resultant was stirred by means of TK Homomixer at 8,000 rpm to homogeneously disperse, to thereby obtain Toner Material Liquid 3. Thereafter, Toner 3 was obtained in the same manner as in Example 1, provided that Toner Material Liquid 1 was replaced with Toner Material Liquid 3.

Example 4

A beaker was charged with 56 parts of Crystalline Polyester Resin 1, 44 parts of Non-Crystalline Polyester Resin 1, 14 parts of Releasing Agent Dispersion Liquid 1, 10 parts of Colorant Dispersion Liquid 1, and 84 parts of ethyl acetate, and the resins were dissolved at 50° C. with stirring. Then, the resultant was stirred by means of TK Homomixer at 8,000 rpm to homogeneously disperse, to thereby obtain Toner Material Liquid 4. Thereafter, Toner 4 was obtained in the same manner as in Example 1, provided that Toner Material Liquid 1 was replaced with Toner Material Liquid 4.

Example 5

Toner 5 was obtained in the same manner as in Example 1, provided that Crystalline Polyester Resin 1 was replaced with Crystalline Polyester Resin 2.

Example 6

Toner 6 was obtained in the same manner as in Example 1, provided that Crystalline Polyester Resin 1 was replaced with Crystalline Polyester Resin 4.

Example 7

Toner 7 was obtained in the same manner as in Example 1, provided that Crystalline Polyester Resin 1 was replaced with Crystalline Polyester Resin 5.

Example 8

Toner 8 was obtained in the same manner as in Example 1, provided that Releasing Agent Dispersion Liquid 1 was replaced with Releasing Agent Dispersion Liquid 2.

Example 9

A beaker was charged with 125 parts of Crystalline Polyester Resin Dispersion Liquid 1, 56 parts of Crystalline Polyester Resin 1, 75 parts of Non-Crystalline Polyester Resin 1, 14 parts of Releasing Agent Dispersion Liquid 1, and 10 parts of Colorant Dispersion Liquid 1, and the resins were dissolved at 25° C. with stirring. Then, the resultant was stirred by means of TK Homomixer at 8,000 rpm to homogeneously disperse, to thereby obtain Toner Material Liquid 9.

A beaker was charged with 101 parts of ion-exchanged water, 6 parts of 25% by weight aqueous dispersion liquid of organic particles (a copolymer of styrene/methacrylic acid/butyl acrylate/a sodium salt of sulfuric acid ester of methacrylic acid-ethylene oxide adduct) for stabilizing dispersion, 1 part of sodium carboxymethyl cellulose, and 9 parts of a 48.5% aqueous solution of sodium dodecyldiphenyl ether disulfonate (ELEMINOL MON-7, manufactured by Sanyo Chemical Industries Ltd.), and the mixture was homogeneously dissolved.

To the resultant, 78 parts of Toner Material Liquid 9 was added with stirring by means of TK Homomixer at 9,000 rpm at 25° C., and the resulting mixture was stirred for 2 minutes.

Subsequently, the resulting mixed liquid was transferred to a flask equipped with a stirring rod and a thermometer, and the ethyl acetate therein was removed at 30° C. until the concentration thereof was to be 0.5% or lower. Thereafter, the resultant was cooled to 20° C. at the cooling rate of 5° C./min, to thereby Aqueous Resin Dispersion of Resin Particles 9.

As for the washing step, subsequently, Aqueous Resin Dispersion of Resin Particles 9 was filtered, and 300 parts by mass of ion-exchanged water was added to the obtained filtration cake. The resultant was mixed by means of TK Homomixer for 10 minutes at 12,000 rpm, followed by filtering the resulting mixture. This course of processes was performed twice.

Next, 300 parts by mass of ion-exchanged water was added to the obtained filtration cake, and the resulting mixture was mixed by means of TK Homomixer for 10 minutes at 12,000 rpm, followed by filtering the mixture. This course of processes was performed three times. To the obtained filtration cake, 300 parts by mass of 1% by mass hydrochloric acid was added, and the resulting mixture was mixed by means of TK Homomixer for 10 minutes at 12,000 rpm, followed by filtering the mixture. Finally, to the obtained filtration cake, 300 parts by mass of ion-exchanged water is added, and the resulting mixture was mixed by means of TK Homomixer for 10 minutes at 12,000 rpm, followed by filtering the mixture. This course of processes was performed twice, to thereby obtain a filtration cake.

After pulverizing the obtained cake, the resultant was dried for 22 hours at 40° C., to thereby obtain Resin Particles 9 having the volume average particle diameter of 5.8 μm.

By means of HENSCHEL MIXER (manufactured by Nippon Cole & Engineering Co., Ltd.), 100 parts by mass of Resin Particles 9 were mixed with 1.0 part by mass of hydrophobic silica (H2000, manufactured by Clariant Japan K.K.) serving as external additives for 30 seconds at the rim speed of 30 m/sec., followed by rested for 1 minute. This cycle of the mixing process was performed 5 times, followed by sieving the resultant with a mesh having an opening size of 35 μm, to thereby produce Toner 9.

Example 10

Toner 10 was obtained in the same manner as in Example 1, provided that Crystalline Polyester Resin 1 was replaced with Crystalline Polyester Resin 3.

Example 11

Toner 11 was obtained in the same manner as in Example 1, provided that Non-Crystalline Polyester Resin 1 was replaced with Non-Crystalline Polyester Resin 2.

Example 12

Toner 12 was obtained in the same manner as in Example 1, provided that Non-Crystalline Polyester Resin 1 was replaced with Non-Crystalline Polyester Resin 3.

Example 13

A beaker was charged with 20 parts of Crystalline Polyester Resin 1, 5 parts of Crystalline Polyester Resin 6, 75 parts of Non-Crystalline Polyester Resin 1, 14 parts of Releasing Agent Dispersion Liquid 1, 10 parts of Colorant Dispersion Liquid 1, and 84 parts of ethyl acetate, and the resins were dissolved at 50° C. with stirring. Then, the resultant was stirred by means of TK Homomixer at 8,000 rpm to homogeneously disperse, to thereby obtain Toner Material Liquid 13. Thereafter, Toner 13 was obtained in the same manner as in Example 1, provided that Toner Material Liquid 1 was replaced with Toner Material Liquid 13.

Example 14

Toner Material Liquid 1 was prepared in the same manner as in Example 1. A beaker was charged with 99 parts of ion-exchanged water, 6 parts of 25% by weight aqueous dispersion liquid of organic particles (a copolymer of styrene/methacrylic acid/butyl acrylate/a sodium salt of sulfuric acid ester of methacrylic acid-ethylene oxide adduct) for stabilizing dispersion, 1 part of sodium carboxymethyl cellulose, and 10 parts of a 48.5% aqueous solution of sodium dodecyldiphenyl ether disulfonate (ELEMINOL MON-7, manufactured by Sanyo Chemical Industries Ltd.), and the mixture was homogeneously dissolved.

To the resultant, 75 parts of Toner Material Liquid 1 was added with stirring by means of TK Homomixer at 10,000 rpm at 50° C., and the resulting mixture was stirred for 2 minutes. Subsequently, the resulting mixed liquid was transferred to a flask equipped with a stirring rod and a thermometer, and the ethyl acetate therein was removed at 55° C. until the concentration thereof was to be 0.5% or lower. Thereafter, the resultant was cooled to 20° C. at the cooling rate of 1° C./min, to thereby Aqueous Resin Dispersion of Resin Particles 14. Thereafter, a washing step was carried out in the same manner as in Example 1, to thereby obtain Toner 14.

Comparative Example 1

Toner 101 was obtained in the same manner as in Example 1, provided that Non-Crystalline Polyester Resin 1 was replaced with Non-Crystalline Polyester Resin 4.

Comparative Example 2

Toner 102 was obtained in the same manner as in Example 1, provided that Crystalline Polyester Resin 1 was replaced with Crystalline Polyester Resin 6.

Comparative Example 3

A beaker was charged with 100 parts of Non-Crystalline Polyester Resin 1, 14 parts of Releasing Agent Dispersion Liquid 1, 10 parts of Colorant Dispersion Liquid 1, and 84 parts of ethyl acetate, and the resins were dissolved at 50° C. with stirring. Then, the resultant was stirred by means of TK Homomixer at 8,000 rpm to homogeneously disperse, to thereby obtain Toner Material Liquid 103. Thereafter, Toner 103 was obtained in the same manner as in Example 1, provided that Toner Material Liquid 1 was replaced with Toner Material Liquid 103.

Comparative Example 4

Toner 104 was obtained in the same manner as in Example 1, provided that Crystalline Polyester Resin 1 was replaced with Crystalline Polyester Resin 6, and Non-Crystalline Polyester Resin 1 was replaced with Non-Crystalline Polyester Resin 4.

Comparative Example 5

A beaker was charged with 61 parts of Crystalline Polyester Resin 1, 39 parts of Non-Crystalline Polyester Resin 1, 14 parts of Releasing Agent Dispersion Liquid 1, 10 parts of Colorant Dispersion Liquid 1, and 84 parts of ethyl acetate, and the resins were dissolved at 50° C. with stirring. Then, the resultant was stirred by means of TK Homomixer at 8,000 rpm to homogeneously disperse, to thereby obtain Toner Material Liquid 105. Thereafter, Toner 105 was obtained in the same manner as in Example 1, provided that Toner Material Liquid 1 was replaced with Toner Material Liquid 105.

[Evaluation Methods]

The toners obtained in Examples and Comparative Examples are evaluated in the following methods.

[Fixing Ability]

A solid image with a width of 50 mm was formed on plain paper (Multi Paper Super White J, product of ASKUL) so that a toner deposition amount was to be 0.90 mg/cm$^2$±0.1 mg/cm$^2$. By means of a modified apparatus, in which a fixing unit of a color laser printer IPSIO SP C420 (manufactured by Ricoh Company Limited) had been modified, the formed image was passed through at the linear speed of 280 mm/min, while the temperature of the fixing member was externally controlled.

Next, a sapphire needle (radius: 125 μm) was brought into contact with, and run on the colored area of the fixed image by means of a spiral scoring tester AD-401 manufactured by Ueshima Seisakusho Co., Ltd. under the conditions that the rotation diameter of the needle was 8 mm, and a load was 1 g. The surface on which the edge of the sapphire needle was run was visually observed, and the lowest temperature at which a scratch was not observed at all was determined as the minimum fixing temperature.

Moreover, glossiness (60°) of each image was measured, and the glossiness was plotted against the temperature. The temperature just before the reduction in the glossiness was observed was determined as the maximum fixing temperature.

[Evaluation of Heat Resistant Storage Stability]

A glass vessel was charged with the toner, and the glass vessel was left to stand in a thermostat the temperature of which was set to 55° C. for 24 hours. The toner was then cooled to 24° C., and subjected to a penetration degree test (JIS K2235-1991) to measure a penetration degree. The toner having the larger penetration degree means the toner having excellent storage stability against heat. The penetration degree is preferably 20 mm or greater. When the penetration degree is less than 15 mm, a possibility for causing a problem on practical use is high. The evaluation criteria of the heat resistant storage stability based on the penetration degree were as follows.

A: Penetrated through

B: 25 mm or greater

C: 20 mm or greater but less than 25 mm

D: 15 mm or greater but less than 20 mm

E: Less than 15 mm

[Image Noise after Endurance Test]

The toner was set in a color laser printer IPSIO SP C420 (manufactured by Ricoh Company Limited), and an image having an imaging ratio of 2% was printed on 2,500 sheets at 28° C., 60% RH.

Thereafter, a half-tone image was printed on 5 sheets, and a presence of dot-shaped image noise on the image was checked.

The evaluation criteria were as follows.

A: The dot-shaped image noise was not confirmed at all.

B: The dot-shaped image noise was confirmed on 1 to 2 sheets out of the 5 sheets.

C: The dot-shaped image noise was confirmed on 3 or more sheets out of the 5 sheets, and a number thereof was 1 to 2 per sheet.

D: The dot-shaped image noise was confirmed on 3 or more sheets out of the 5 sheets, and a number thereof was 3 to 9 per sheet.

E: The dot-shaped image noise was confirmed on 3 or more sheets out of the 5 sheets, and a number thereof was 10 or more per sheet.

Next, a solid image was printed on 1 sheet, and a formation of a white mixing part in the image was observed and evaluated. The evaluation criteria were as follows.

A: A white missing part was not confirmed at all.

B: A fine white missing part was slightly confirmed as observed minutely.

C: A white missing part was slightly observed at first glance.

D: A white missing part was observed at first glance.

E: A white missing part was significantly observed at first glance.

The results are collectively presented in the following tables.

TABLE 1-1

| | Material Composition | | | | | | | | | | | |
|---|---|---|---|---|---|---|---|---|---|---|---|---|
| | Non-crystalline polyester resin | | Crystalline polyester resin | | | | | | | Releasing agent | | |
| | No. | BPA (%) | No. | Ut/Ua | Mp (° C.) | Loaded amount | Aspect ratio | d (nm) | Area % | No. | mp (° C.) | Ac-sol (%) |
| Ex. 1 | 1 | 0 | 1 | Yes | 57 | 25 | 1.5 | 200 | 23 | 1 | 73 | 1 |
| Ex. 2 | 1 | 0 | 1 | Yes | 57 | 9 | 1.2 | 80 | 7 | 1 | 73 | 1 |
| Ex. 3 | 1 | 0 | 1 | Yes | 57 | 49 | 1.6 | 440 | 48 | 1 | 73 | 1 |
| Ex. 4 | 1 | 0 | 1 | Yes | 57 | 54 | 1.8 | 520 | 53 | 1 | 73 | 1 |
| Ex. 5 | 1 | 0 | 2 | Yes | 62 | 25 | 1.9 | 270 | 24 | 1 | 73 | 1 |
| | | | | Small | | | | | | | | |
| Ex. 6 | 1 | 0 | 4 | Yes | 44 | 25 | 1.4 | 220 | 23 | 1 | 73 | 1 |
| Ex. 7 | 1 | 0 | 5 | Yes | 69 | 25 | 1.6 | 190 | 24 | 1 | 73 | 1 |
| Ex. 8 | 1 | 0 | 1 | Yes | 57 | 25 | 1.8 | 250 | 23 | 2 | 68 | 12 |
| Ex. 9 | 1 | 0 | 1 | Yes | 57 | 25 | 2.3 | 340 | 23 | 1 | 73 | 1 |
| Ex. 10 | 1 | 0 | 3 | Yes | 56 | 25 | 1.6 | 610 | 22 | 1 | 73 | 1 |
| | | | | Large | | | | | | | | |
| Ex. 11 | 2 | 5 | 1 | Yes | 57 | 25 | 1.4 | 170 | 19 | 1 | 73 | 1 |
| Ex. 12 | 3 | 9.5 | 1 | Yes | 57 | 25 | 1.3 | 150 | 16 | 1 | 73 | 1 |
| Ex. 13 | 1 | 0 | 1/6 = 4/1 | Yes/No | 57/67 | 25 | 1.8 | 230 | 24 | 1 | 73 | 1 |
| Ex. 14 | 1 | 0 | 1 | Yes | 57 | 25 | 3.1 | 290 | 24 | 1 | 73 | 1 |
| Comp. Ex. 1 | 4 | 65 | 1 | Yes | 57 | 25 | — | — | — | 1 | 73 | 1 |
| Comp. Ex. 2 | 1 | 0 | 6 | No | 67 | 25 | — | — | — | 1 | 73 | 1 |
| Comp. Ex. 3 | 1 | 0 | — | — | — | — | — | — | — | 1 | 73 | 1 |
| Comp. Ex. 4 | 4 | 65 | 6 | No | 67 | 25 | 15.2 | 330 | 24 | 1 | 73 | 1 |
| Comp. Ex. 5 | 1 | 0 | 1 | Yes | 57 | 61 | — | — | — | 1 | 73 | 1 |

TABLE 1-2

| | | Cross section | | Evaluation | | | |
|---|---|---|---|---|---|---|---|
| | Production method | State of cross section | Material of islands | Fixing (° C.) | Storage | OPC film | Black spots in image |
| Ex. 1 | Dissolution-phase separation | Sea-island | Crystalline polyester resin | 110 | A | A | A |
| Ex. 2 | Dissolution-phase separation | Sea-island | Crystalline polyester resin | 120 | A | A | A |
| Ex. 3 | Dissolution-phase separation | Sea-island | Crystalline polyester resin | 105 | A | B | B |
| Ex. 4 | Dissolution-phase separation | Sea-island | Crystalline polyester resin | 105 | B | D | D |
| Ex. 5 | Dissolution-phase separation | Sea-island | Crystalline polyester resin | 110 | B | C | C |
| Ex. 6 | Dissolution-phase separation | Sea-island | Crystalline polyester resin | 105 | C | B | A |
| Ex. 7 | Dissolution-phase separation | Sea-island | Crystalline polyester resin | 120 | A | A | A |
| Ex. 8 | Dissolution-phase separation | Sea-island | Crystalline polyester resin | 110 | D | B | B |
| Ex. 9 | Crystallization | Sea-island | Crystalline polyester resin | 110 | D | D | D |
| Ex. 10 | Dissolution-phase separation | Sea-island | Crystalline polyester resin | 120 | C | D | C |
| Ex. 11 | Dissolution-phase separation | Sea-island | Crystalline polyester resin | 110 | B | B | B |
| Ex. 12 | Dissolution-phase separation | Sea-island | Crystalline polyester resin | 110 | C | C | C |
| Ex. 13 | Dissolution-phase separation | Sea-island | Crystalline polyester resin | 105 | A | B | B |
| Ex. 14 | Dissolution-phase separation (slow) | Sea-island | Crystalline polyester resin | 110 | D | D | D |
| Comp. Ex. 1 | Dissolution-phase separation | Homogeneous | — | 105 | E | E | E |

TABLE 1-2-continued

| | | Cross section | | Evaluation | | | |
|---|---|---|---|---|---|---|---|
| | Production method | State of cross section | Material of islands | Fixing (° C.) | Storage | OPC film | Black spots in image |
| Comp. Ex. 2 | Dissolution-phase separation | Lamella | Crystalline polyester resin | 110 | C | E | C |
| Comp. Ex. 3 | Dissolution suspension | Homogeneous | — | 145 | A | A | A |
| Comp. Ex. 4 | Dissolution-phase separation | Sea-island | Crystalline polyester resin | 115 | C | E | D |
| Comp. Ex. 5 | Dissolution-phase separation | Sea-island | Non-crystalline polyester resin | 100 | B | E | E |

In Table 1-1, "d" denotes the average particle diameter, and "ac-sol" denotes an ethyl acetate soluble component of the releasing agent.

In Table 1-1, moreover, "BPA" denotes the component represented by the general formula (1).

In Table 1-1, "Area %" denotes a ratio (%) of the area of the crystalline polyester resin dispersed in the cross-sectional structure of the toner to the entire toner particle.

This application claims priority to Japanese application No. 2013-102756, filed on May 15, 2013 and incorporated herein by reference.

What is claimed is:

1. A toner, comprising:

toner particles, wherein the toner particles contain:

a non-crystalline resin; and a crystalline resin, wherein the crystalline resin contains a crystalline resin C containing a urethane bond, or a urea bond, or both thereof, wherein the toner particles each have a sea-island structure, where the resin C is dispersed in the non-crystalline resin on a cross-section of the toner particle, and wherein an aspect ratio of the resin C dispersed on the cross-section is from 1.2 to 2.

2. The toner according to claim 1, wherein the resin C dispersed on the cross-section has an average particle diameter of 50 nm to 500 nm.

3. The toner according to claim 1, wherein an area of the resin C dispersed on the cross-section is less than 50% or less relative to an entire area of the toner particle.

4. The toner according to claim 1, wherein an area of the resin C dispersed on the cross-section is 10% to 45% relative to the whole toner particle.

5. The toner according to claim 1, wherein the resin C has a melting point of 40° C. to 70° C.

6. The toner according to claim 1, wherein the toner particles further contain a releasing agent having a melting point of 60° C. to 85° C.

7. The toner according to claim 6, wherein an ethyl acetate soluble component in the releasing agent at 50° C. is less than 10% by mass.

8. The toner according to claim 1, wherein a component represented by the following general formula (1) is 0 mol % to 10 mol % relative to an alcohol component constituting the non-crystalline resin:

$$HO—(R1\text{-}O)_n—C_6H_4—C(CH_3)_2—C_6H_4—(R2\text{-}O)_m—OH \qquad \text{General Formula (1)}$$

where R1 and R2 are each C2-C4 divalent saturated hydrocarbon coupling group, and n and m are each a positive number of 1 to 2.

9. A developer, comprising:

a carrier; and the toner according to claim 1.

* * * * *